US008017883B2

(12) United States Patent
Kiyono et al.

(10) Patent No.: US 8,017,883 B2
(45) Date of Patent: Sep. 13, 2011

(54) SWITCH

(75) Inventors: Yasuhiro Kiyono, Nagaokakyo (JP); Toshihiro Naruo, Kyoto (JP)

(73) Assignee: OMRON Corporation, Kyoto (JP)

( * ) Notice: Subject to any disclaimer, the term of this patent is extended or adjusted under 35 U.S.C. 154(b) by 575 days.

(21) Appl. No.: 12/164,629

(22) Filed: Jun. 30, 2008

(65) Prior Publication Data

US 2009/0008230 A1 Jan. 8, 2009

(30) Foreign Application Priority Data

Jul. 4, 2007 (JP) ..... 2007-176235
Oct. 19, 2007 (JP) ..... 2007-272786

(51) Int. Cl.
*H01H 13/14* (2006.01)

(52) U.S. Cl. ..... 200/520; 200/417

(58) Field of Classification Search ..... 200/520–523, 200/524, 529, 530, 545–558, 16 A–16 F, 200/329, 417, 449, 462–468
See application file for complete search history.

(56) References Cited

U.S. PATENT DOCUMENTS 4,632,481 A 12/1986 Le Magourou
7,009,131 B2 * 3/2006 Diep ..... 200/523

FOREIGN PATENT DOCUMENTS

JP 10-208581 8/1998

OTHER PUBLICATIONS

Patent Abstracts of Japan, Publication No. 10-208581 dated Aug. 7, 1998, 12 pages.
European Search Report for application No. 08156200.1, Dated Nov. 27, 2008, 5 pages.

* cited by examiner

*Primary Examiner* — Edwin A. Leon
*Assistant Examiner* — Marina Fishman
(74) *Attorney, Agent, or Firm* — Osha • Liang LLP

(57) ABSTRACT

A switch includes a base, a support terminal assembled in the base, a movable contact piece made of a belt-like electroconductive material bent into a substantial J-shape in section, a plunger vertically movably accommodated in an internal space, and a coil spring turnably supported by the plunger. The movable contact piece includes a movable contact provided in one end portion thereof. An intermediate portion of the movable contact piece is turnably supported by a turning support portion of the support terminal. The internal space is formed by fitting a housing in the base. The plunger is slid while vertically moved press-contact one end portion of the coil spring against the other end edge portion of the movable contact piece such that the movable contact piece is reversed to bring the movable contact into contact with a fixed contact or to separate the movable contact from the fixed contact.

20 Claims, 26 Drawing Sheets

40,41
50,52
42
23
(24)
10
21
51
30
26
31
45
60
25

40,41
51
52
23
(24)
10
21
30
26
31
45
60
25

40,41
51
52
42
23
(24)
21
30
26
31
45
60
25

40
44d,43
44c
44b
44a
44e
36
35

40
44d,43
36
35
44e

SWITCH

BACKGROUND OF THE INVENTION

1. Field of the Invention

The present invention relates to a switch and, in particular, to a switch in which a contact can be opened and closed by a pressing working.

2. Description of the Related Art

Conventionally, for example, Japanese Patent Application Laid-Open No. 10-208581 discloses a switch structure of the switch in which the contact can be opened and closed by the pressing working.

In the switch structure disclosed in Japanese Patent Application Laid-Open No. 10-208581, a movable terminal 37 is reciprocally moved in a vertical direction by working a button 14, and movable contacts 41 and 41 disposed in end portions of the movable terminal 37 is brought into contact with and separated from facing fixed contacts 45 and 45 respectively.

However, in the switch structure disclosed in Japanese Patent Application Laid-Open No. 10-208581, it is necessary that the movable terminal 37 be supported by a retention spring 46 and a return spring 47. Therefore, the number of components and assembly man-hour are increased to lead to cost increase. Additionally, because the movable terminal 37 follows the working of the button 14, a displacement speed of the movable terminal 37, that is, an opening and closing speed of the contact is substantially equal to a working speed of the button 14, and the contact cannot instantaneously be opened and closed. As a result, a contact having a large contact area is required to prevent contact wear in opening and closing the large-current contact, and disadvantageously the compact switch cannot be realized.

In view of the foregoing, an object of the invention is to provide a compact switch in which a contact can instantaneously be opened and closed while the number of components and assembly man-hour are decreased.

SUMMARY OF THE INVENTION

In accordance with a first aspect of the invention, a switch includes a base; a support terminal which is assembled in the base; a movable contact piece which is made of a belt-like electroconductive material bent into a substantial J-shape in section, the movable contact piece including a movable contact provided in one end portion thereof, an intermediate portion of the movable contact piece being turnably supported by a turning support portion of the support terminal; a plunger which is accommodated in an internal space while being able to be vertically moved, the internal space being formed by fitting a housing in the base; and a coil spring which is turnably supported by the plunger, wherein the plunger is slid while vertically moved press-contact one end portion of the coil spring against the other end edge portion of the movable contact piece, whereby the movable contact piece is reversed to bring the movable contact into contact with a fixed contact or to separate the movable contact from the fixed contact.

According to the first aspect of the invention, the plunger is reciprocally moved to open and close the contact by one coil spring, so that the number of components and the assembly man-hour can be decreased to achieve the cost reduction. Additionally, the movable contact piece is instantaneously reversed by a spring force of the coil spring, and the opening and closing speed of the contact is significantly enhanced, which eliminates the need of using the contact having the large contact area. Therefore, the switch can be miniaturized.

In accordance with a second aspect of the invention, a switch includes a base; a support terminal which is assembled in the base; a movable contact piece which is made of a straight electroconductive material, the movable contact piece including a movable contact provided in one end portion thereof, an intermediate portion of the movable contact piece being turnably supported by a turning support portion of the support terminal; a plunger which is accommodated in an internal space while being able to be vertically moved, the internal space being formed by fitting a housing in the base; and a coil spring which is turnably supported by the plunger, wherein the plunger is slid while vertically moved press-contact one end portion of the coil spring against the other end portion on the upper surface of the movable contact piece, whereby the movable contact piece is reversed to bring the movable contact into contact with a fixed contact or to separate the movable contact from the fixed contact.

According to the second aspect of the invention, the same action and effect as the first aspect can be obtained.

In accordance with a third aspect of the invention, a switch includes a base; a support terminal which is assembled in the base; a movable contact piece which is made of a belt-like electroconductive material bent into a substantial J-shape in section, the movable contact piece including a movable contact provided in one end portion thereof, an intermediate portion of the movable contact piece being turnably supported by a turning support portion of the support terminal; a plunger which is accommodated in an internal space while being able to be vertically moved, the internal space being formed by fitting a housing in the base; and a leaf spring which is made of a belt-like elastic material bent into a substantial V-shape in section, the leaf spring being turnably supported by the plunger, wherein the plunger is slid while vertically moved press-contact one end portion of the leaf spring against the other end edge portion of the movable contact piece, whereby the movable contact piece is reversed to bring the movable contact into contact with a fixed contact or to separate the movable contact from the fixed contact.

According to the third aspect of the invention, the same action and effect as the first aspect can be obtained.

In accordance with a fourth aspect of the invention, a switch includes a base; a support terminal which is assembled in the base; a movable contact piece which is made of a straight electroconductive material, the movable contact piece including a movable contact provided in one end portion thereof, an intermediate portion of the movable contact piece being turnably supported by a turning support portion of the support terminal; a plunger which is accommodated in an internal space while being able to be vertically moved, the internal space being formed by fitting a housing in the base; and a leaf spring which is made of a belt-like elastic material bent into a substantial V-shape in section, the leaf spring being turnably supported by the plunger, wherein the plunger is slid while vertically moved press-contact one end portion of the leaf spring against the other end portion on the upper surface of the movable contact piece, whereby the movable contact piece is reversed to bring the movable contact into contact with a fixed contact or to separate the movable contact from the fixed contact.

According to the fourth aspect of the invention, the same action and effect as the first aspect can be obtained.

In the switch according to the first and third aspects of the invention, preferably a forced disjunction pawl portion is provided in one end portion of the spring, the forced disjunction pawl portion being latched in an edge portion of the other end portion of the movable contact piece to perform forced disjunction between the fixed contact and the movable contact. Accordingly, the contact welding is forcedly solved to suppress the malfunction, so that high-reliability switch can be obtained.

In the switch according to the first and third aspects of the invention, preferably an assembling bent portion is provided in one end portion of the spring, the assembling bent portion being able to be assembled by sliding the assembling bent portion on an edge portion of the other end portion of the movable contact piece. Accordingly, the skilled work is not required in the assembly and the high-productivity switch can be obtained.

In the switch according to the first to fourth aspects of the invention, preferably a position regulating projected strip is projected from an inside surface of the housing fitted in the base, the position regulating projected strip being latched in an upper surface edge portion of the movable contact piece to regulate a position during return. Accordingly, the position of the movable contact piece is regulated by the position regulating projected strip, so that the dropout can be prevented to obtain the switch having a stable operation characteristic.

In the switch according to the first to fourth aspects of the invention, preferably a positioning projected strip is projected from an inside surface of the housing fitted in the base, the positioning projected strip laterally press-contacting the spring to perform positioning. Accordingly, because the spring is located at a position while the dropout of the spring is prevented, the switch having a small variation in operation characteristic can be obtained.

DETAILED DESCRIPTION OF THE PREFERRED EMBODIMENTS

Figure 1B:
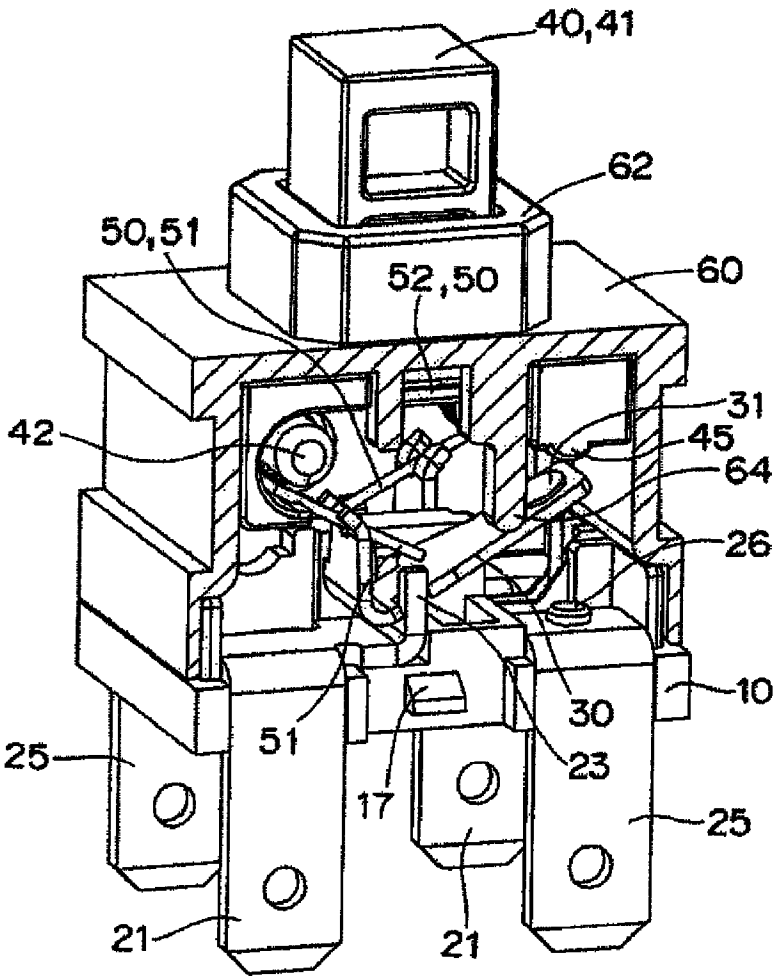
FIGS. 1A and 1B show a perspective view and a partially sectional perspective view of a switch according to a first embodiment of the invention.
Figure 1A:
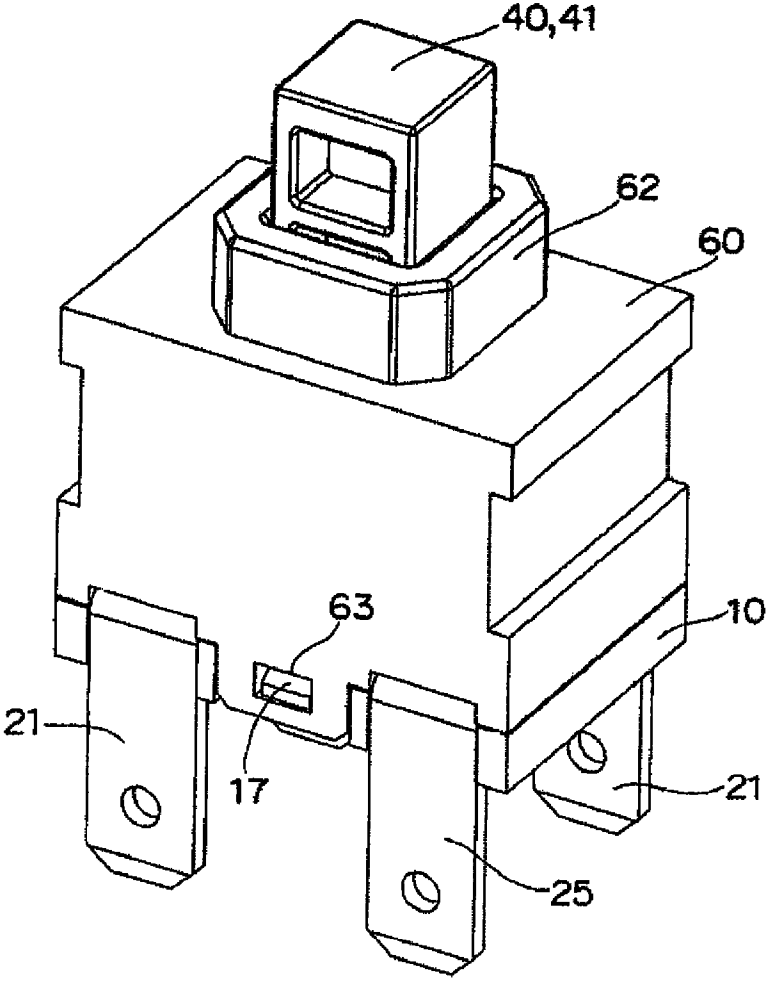

Preferred embodiments of the invention will be described below with reference to the accompanying drawings. Referring to FIGS. 1 to 8, a switch according to a first embodiment of the invention includes a base 10, two sets of contact mechanisms 20 and 20, a plunger 40, and a housing 60. The two sets of contact mechanisms 20 and 20 are assembled into the base 10. The plunger 40 includes a pair of coil springs 50 and 50 and a lock pin 35, and the plunger 40 works the contact mechanism 20. The housing 60 is fitted in the base 10 to cover the contact mechanism 20 therewith, and the housing 60 supports the plunger 40 while the plunger 40 can vertically be moved.

Figure 2:
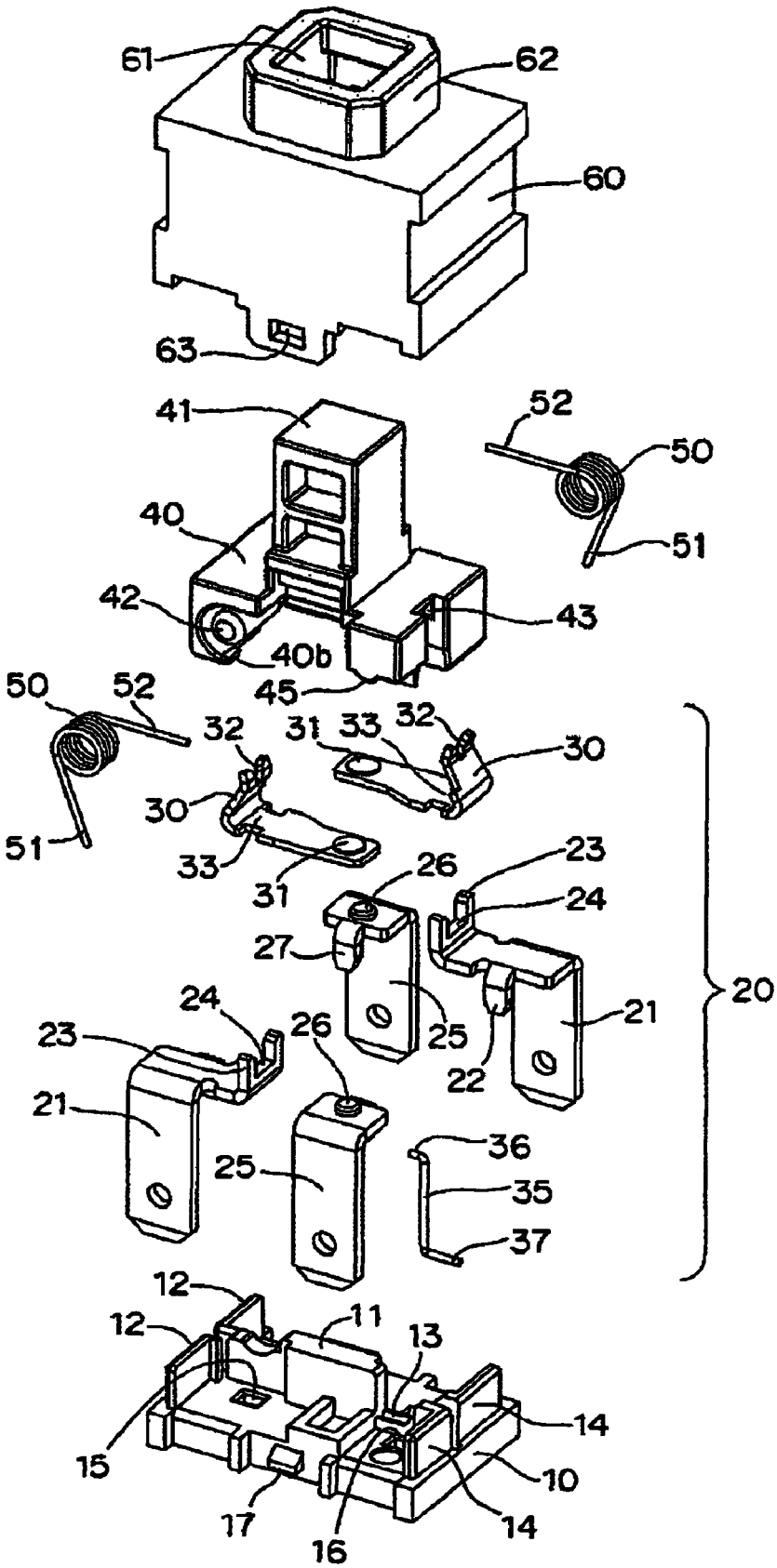
FIG. 2 shows an exploded perspective view of the switch of FIG. 1.

Referring to FIG. 2, in the base 10, a pair of insulating walls 12 and 12 is projected on the same straight line from one end portion side of a partition 11 projected in the center of an upper surface of the base 10, an engagement groove 13 is provided on an extended line on the other end portion side, and a pair of insulating walls 14 and 14 is projected on the same straight line from the other end portion side of the engagement groove 13. Press-fitting rectangular holes 15 and 16 are made near the insulating walls 12 and 14 respectively. Engaging projections 17 and 17 are provided in parallel outside surfaces of the base 10 respectively.

As shown in FIG. 2, the contact mechanism 20 includes a support terminal 21, a fixed contact terminal 25, and a movable contact piece 30. The support terminal 21 is made of an electroconductive material bent into an L-shape in section. A press-fitting tongue piece 22 is extended from an edge portion of one end portion of the support terminal 21, and a front-end edge portion of a rising piece 23 extended from one end portion of the support terminal 21 is notched to form a turning support portion 24. The support terminal 21 is assembled by press-fitting the press-fitting tongue piece 22 in the press-fitting rectangular hole 15 of the base 10.

The fixed contact terminal 25 is bent into an L-shape in section. In the fixed contact terminal 25, a fixed contact 26 is provided in one end portion, and a press-fitting tongue piece 27 is extended from an edge portion of one end portion. The fixed contact terminal 25 is assembled by press-fitting the press-fitting tongue piece 27 in the press-fitting rectangular hole 16 of the base 10.

The movable contact piece 30 is made of a belt-like electroconductive material bent into a J-shape in section. In the movable contact piece 30, a movable contact 31 is provided in one end portion, and a sliding notch groove 32 is formed in a front-end surface of the other end portion. The movable contact piece 30 is turnably supported by engaging a narrow portion 33 with the turning support portion 24 of the support terminal 21 (see FIG. 3B). The narrow portion 33 is formed by notching edge portions on both side of the movable contact piece 30.

In the lock pin 35, end portions of a metal rod are bent toward opposite directions to form upper and lower end portions 36 and 37.

Figure 3A:
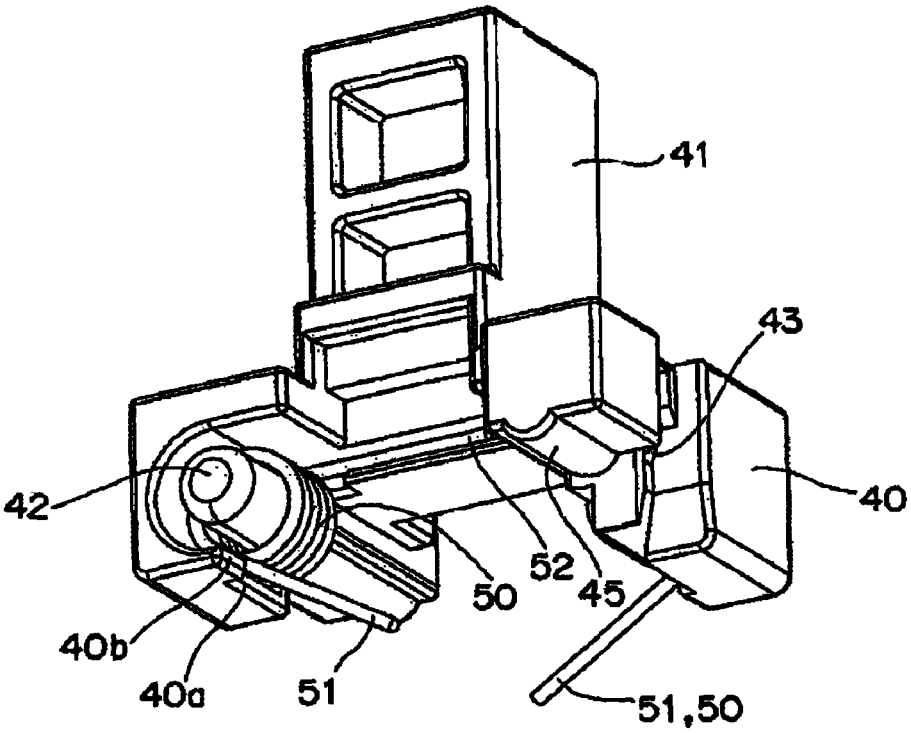
FIGS. 3A and 3B show perspective views of a plunger and a base of FIG. 2.
Figure 3B:
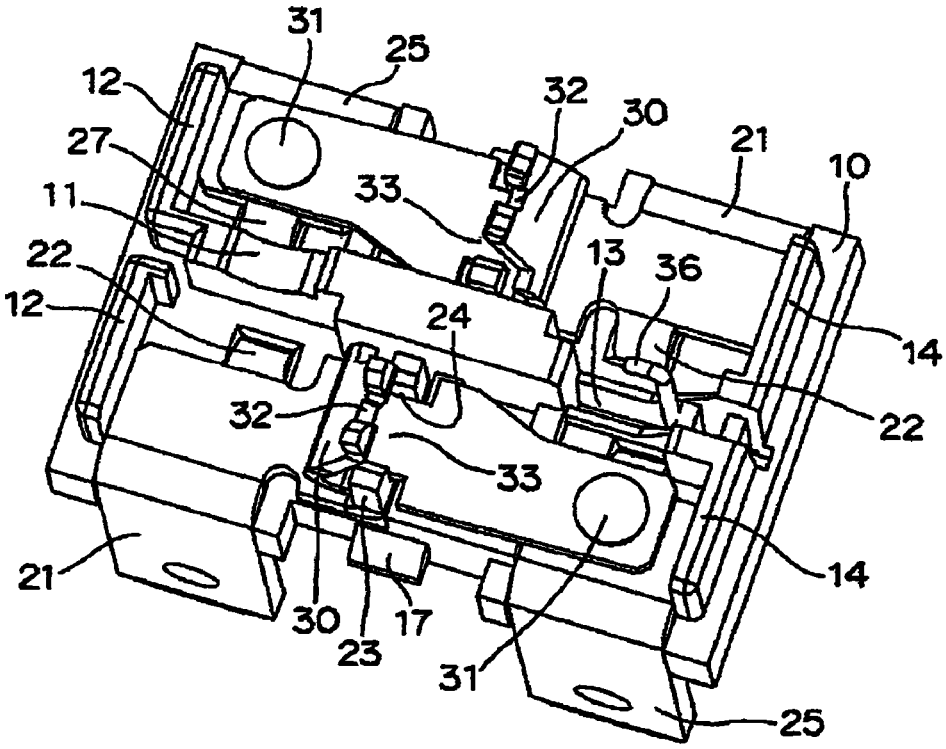
Figure 4:
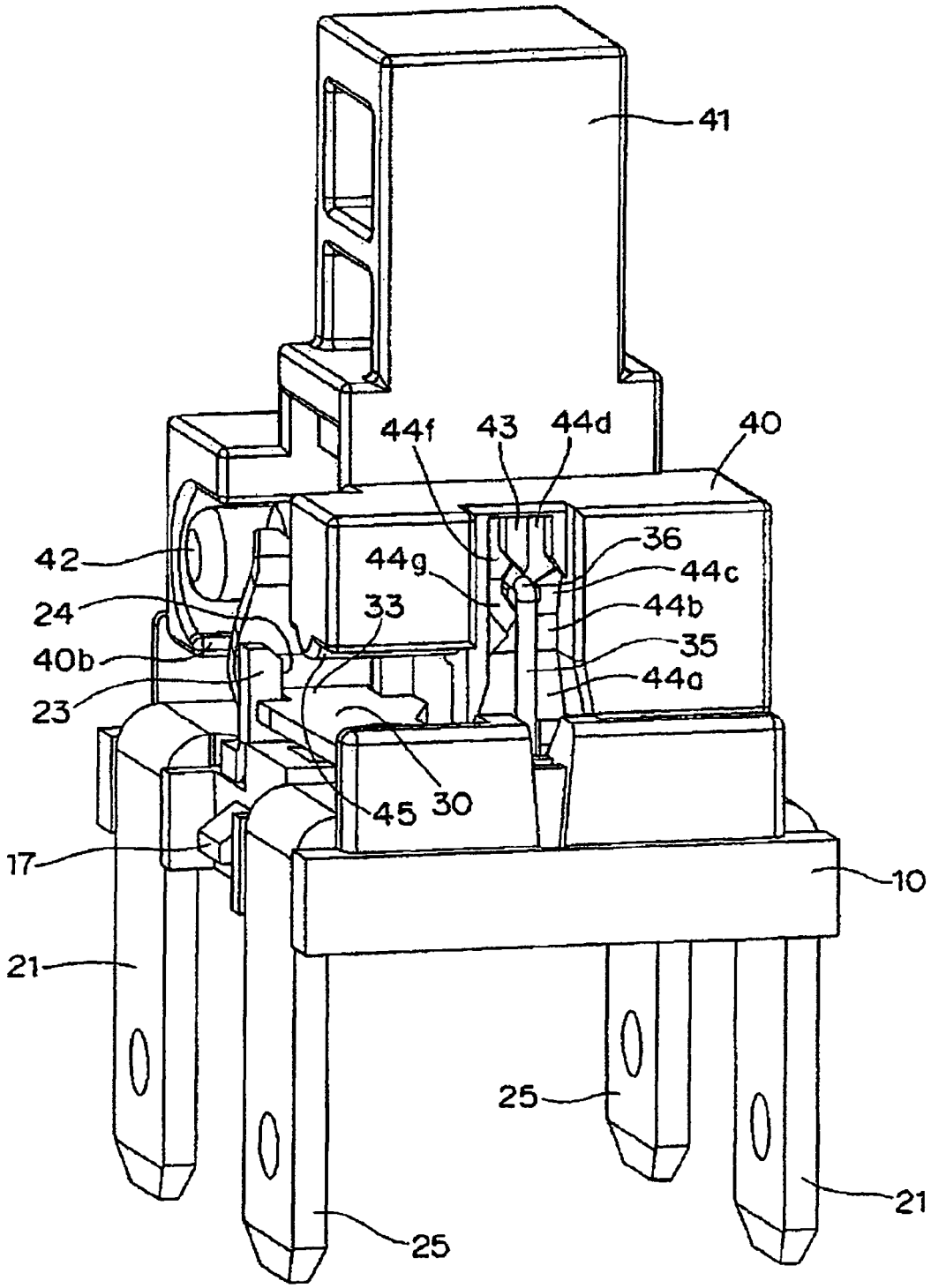
FIG. 4 shows a perspective view of a state in which a housing is detached from the switch of FIG. 1

As shown in FIG. 2, the plunger 40 has a flat surface shape which can be accommodated between the facing insulating walls 12 and 14 of the base 10, and a working portion 41 is projected from the center of an upper surface of the plunger 40. In the plunger 40, shaft portions 42 are point-symmetrically formed in a front surface and a rear surface, and the shaft portions 42 are laterally inserted into coil springs 50 and 50 to support the coil springs 50 and 50. A cam groove 43 is formed in an outside surface of the plunger 40. The cam groove 43 locks the plunger 40 at a position while the lock pin 35 is interposed therebetween. As shown in FIG. 3A, a pressing projection 45 is provided in parallel with the shaft portion 42 in a lower surface of the plunger 40. As shown in FIG. 3A, end portions 51 and 52 of the coil spring 50 are flexed inside, and the shaft portions 42 of the plunger 40 are inserted into the end portions 51 and 52, whereby the end portion 52 press-contacts a ceiling surface of the plunger 40 while the end portion 51 press-contacts an edge portion 40*a* of the plunger 40. Therefore, the end portion 51 of the coil spring 50 engages a projection 40*b* of the plunger 40, so that dropout of the coil spring 50 can be prevented to facilitate assembling work.

As shown in FIG. 2, the housing 60 has a box shape so as to be able to be fitted in an outer peripheral portion of the base 10 in which the contact mechanism 20 and the plunger 40 are assembled, and a circular rib 62 is provided in an opening edge portion of a working hole 61 made in the center of an upper surface of the housing 60. A pair of engagement hole 63 is made in a lower opening edge portion of the housing 60 so as to face each other.

In the case where the switch of the first embodiment is assembled, the lower end portion 37 of the lock pin 35 is inserted from above in the engagement groove 13 of the base 10 in which the contact mechanism 20 is assembled, and the lock pin 35 is laterally slid to prevent the dropout. The plunger 40 in which the coil spring 50 is assembled is positioned by accommodating the plunger 40 from above between the insulating wall 12 and 14 of the base 10, whereby the upper end portion 36 of the lock pin 35 engages the cam groove 43 of the plunger 40 (see FIG. 4). Then, the engaging projection 17 of the base 10 engages the engagement hole 63 of the housing 60. Therefore, the working portion 41 of the plunger 40 is projected from the working hole 61 of the housing 60. The end portion 51 of the coil spring 50 slidably engages the sliding notch groove 32 of the movable contact piece 30, and the coil spring 50 biases the movable contact piece 30 so as to raise the movable contact piece 30 (see FIGS. 1B and 5A). Therefore, the movable contact 31 of the movable contact piece 30 is separated from the fixed contact 26.

Figures 5A, 5B, 5C, 5D, 5E:
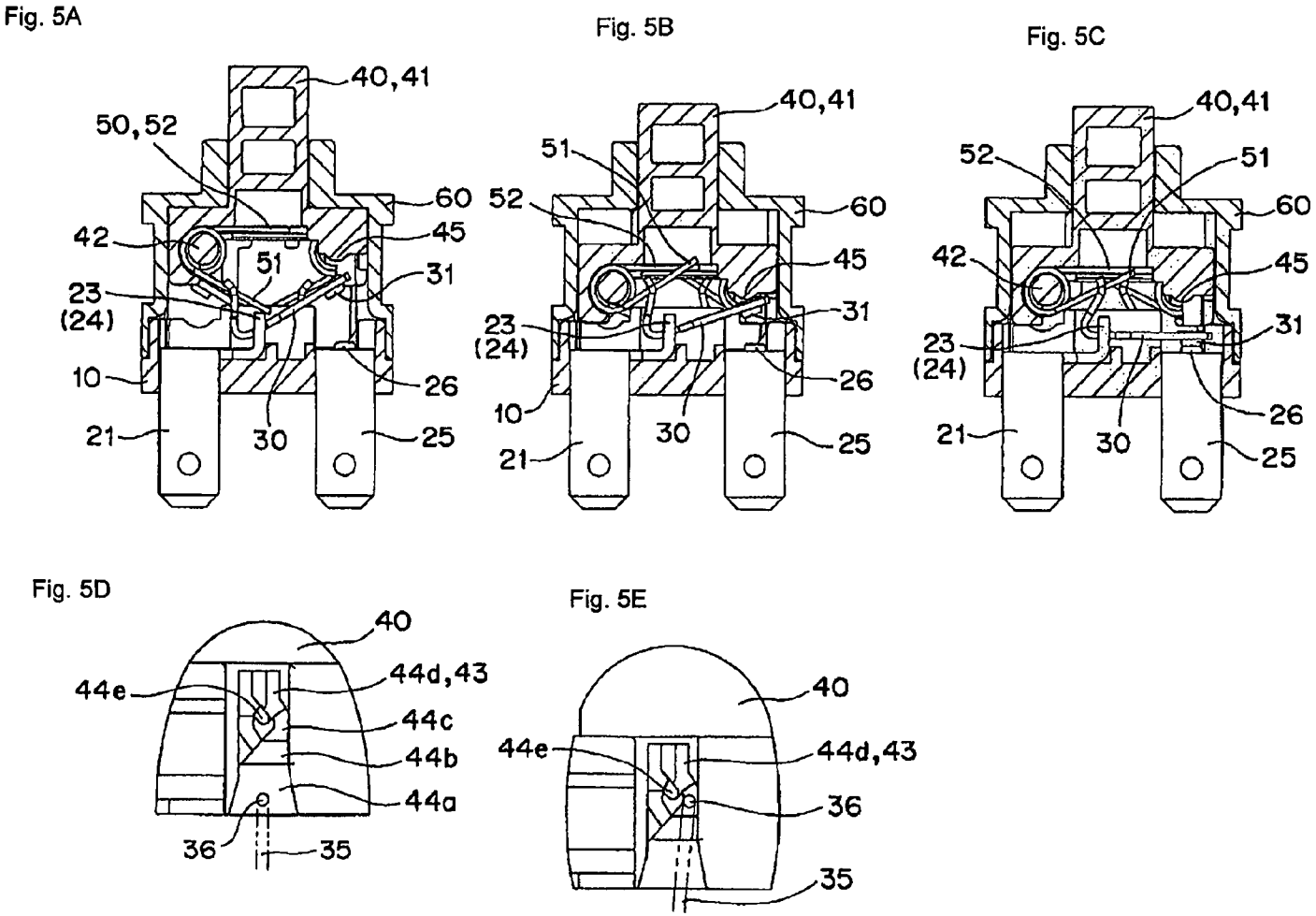
FIGS. 5A, 5B, and 5C show sectional views of a working procedure.
FIGS. 5D and 5E show partially enlarged views of a cam mechanism operation.

A method for working the switch of the first embodiment will described below. As shown in FIG. 5A, before working the switch, the plunger 40 is biased upward by a spring force of the coil spring 50. On the other hand, the end portion 51 of the coil spring 50 pushes down the other end portion of the movable contact piece 30. Therefore, one end portion of the movable contact piece 30 abuts on a lower end portion of a position regulating projected strip 64 (see FIG. 1B) projected from an inside surface of the housing 60, thereby regulating the position of the movable contact piece 30 to prevent the dropout. At this point, as shown in FIG. 5D, the upper end portion 36 of the lock pin 35 is located in an initial region 44*a* of the cam groove 43 of the plunger 40.

When the working portion 41 of the plunger 40 is pushed down, the coil spring 50 is flexed, and the end portion 51 of the coil spring 50 biases the movable contact piece 30 so as to raise the movable contact piece 30 while being slid in a notch groove 32 of the movable contact piece 30. The pressing projection 45 pushes down one end portion of the movable contact piece 30. At this point, the upper end portion 36 of the lock pin 35 is moved from the initial region 44*a* of the cam groove 43 through first and second inclined grooves 44*b* and 44*c*. When the end portion 51 of the coil spring 50 exceeds a predetermined position by pushing into the working portion 41 of the plunger 40, the end portion 51 of the coil spring 50 biases the movable contact piece 30 so as to push down the movable contact piece 30. Therefore, the movable contact piece 30 is instantaneously turned about the turning support portion 24, and the movable contact 31 contacts the fixed contact 26 (see FIG. 5C).

Figure 6B:
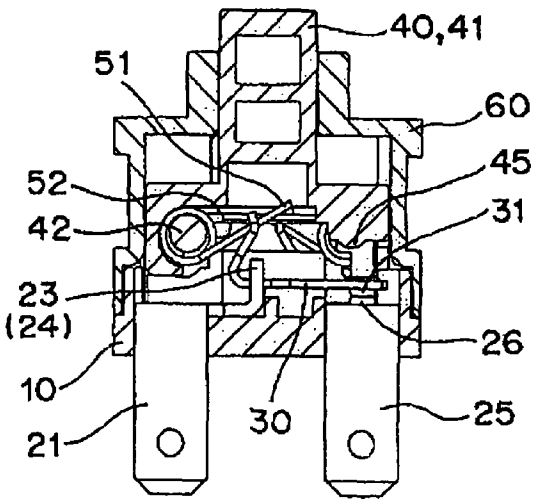
FIGS. 6A and 6B show sectional views of the working procedure subsequent to FIG. 5, and FIGS. 6C and 6D show partially enlarged views of the cam mechanism operation subsequent to FIG. 5.
Figure 6D:
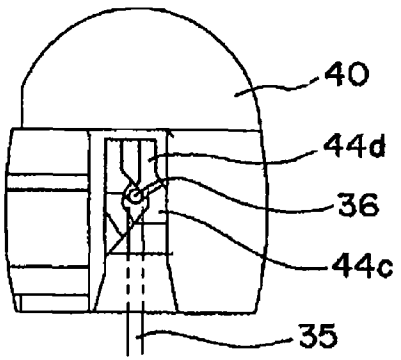
Figure 6A:
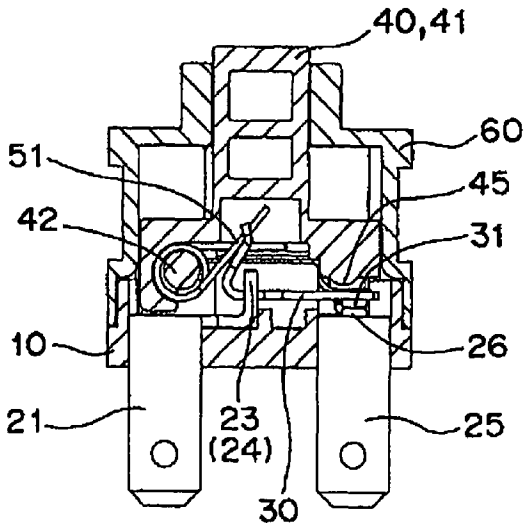
Figure 6C:
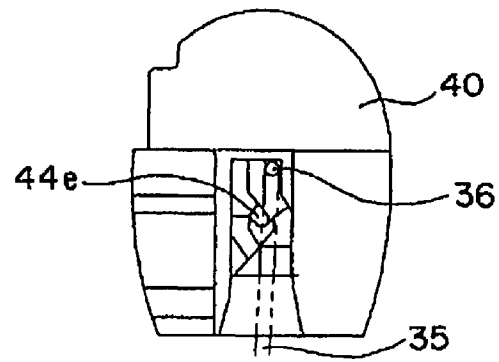

Then, the working portion 41 of the plunger 40 is pushed into the lowest position of the working portion 41 (see FIG. 6A), whereby the upper end portion 36 of the lock pin 35 reaches a third inclined groove 44*d* (see FIG. 6C). When the pressing of the plunger 40 is released, the plunger 40 is pushed up by the spring force of the coil spring 50. At this point, the upper end portion 36 of the lock pin 35 latches the plunger 40 at a lock position 44*e* (see FIG. 6D) to regulate the upward return of the plunger 40, and the plunger 40 becomes a locked state. Therefore, the end portion 51 of the coil spring 50 continuously biases the movable contact piece 30 so as to push down the movable contact piece 30, and the movable contact 31 continuously contacts the fixed contact 26 (see FIG. 6B).

Figure 7B:
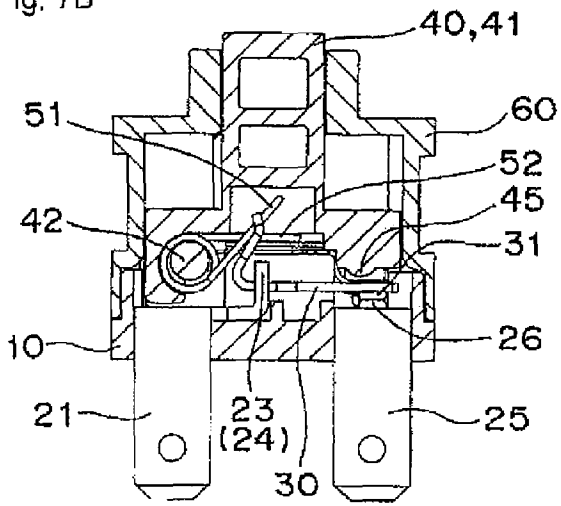
FIGS. 7A and 7B show sectional views of the working procedure subsequent to FIG. 6, and FIGS. 7C and 7D show partially enlarged views of the cam mechanism operation subsequent to FIG. 6.
Figure 7D:
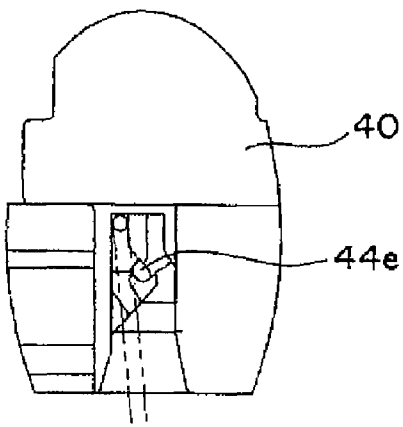
Figure 7A:
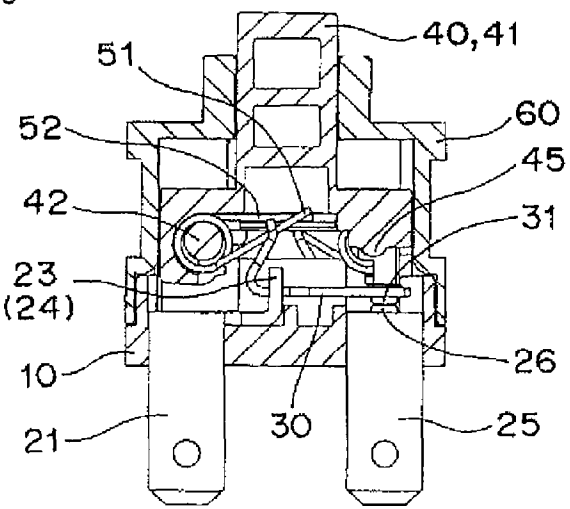
Figure 7C:
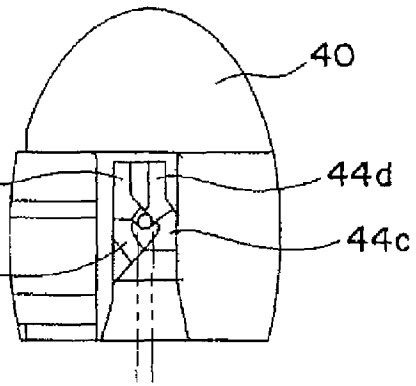
Figure 8C:
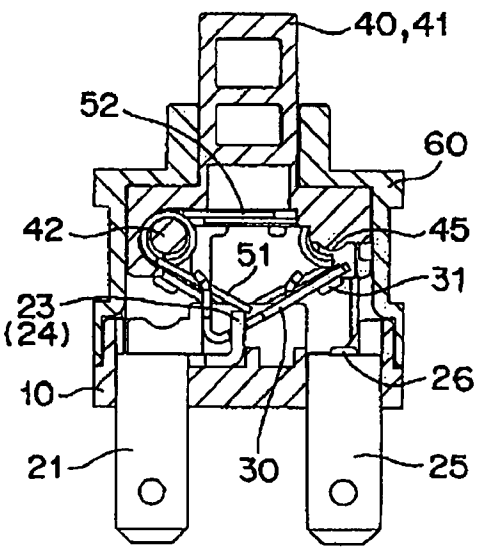
FIGS. 8A, 8B, and 8C show sectional views of the working procedure subsequent to FIG. 7, and FIGS. 8D and 8E show partially enlarged views of the cam mechanism operation subsequent to FIG. 7.
Figure 8B:
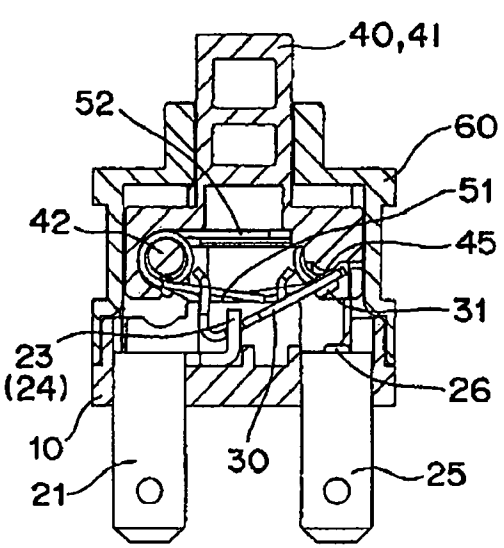
Figure 8A:
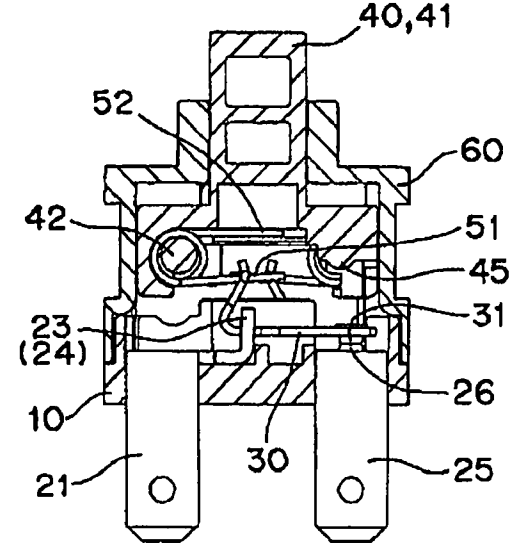
Figure 8E:
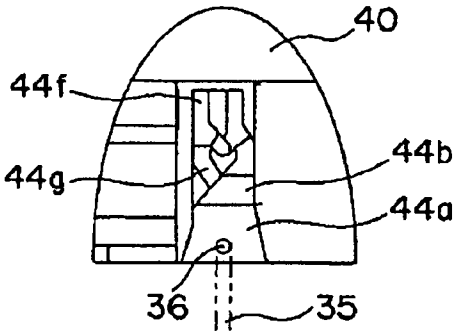
Figure 8D:
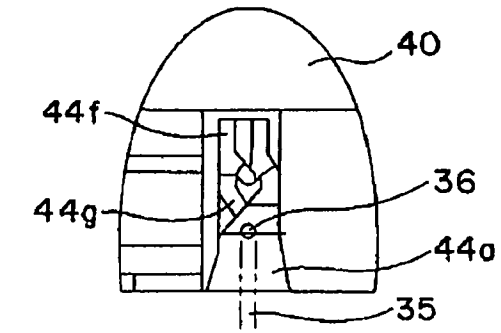

In the case where the locked state (see FIGS. 7A and 7C) is released, the working portion 41 of the plunger 40 is further pushed down (see FIG. 7B), whereby the upper end portion 36 of the lock pin 35 is moved from a lock position to a fourth inclined groove 44*f* to release the locked state (see FIG. 7D). When the pressing against the working portion 41 is released, the coil spring 50 pushes up the plunger 40 while biasing the movable contact piece 30 so as to push down the movable contact piece 30 (see FIG. 8A), and the upper end portion 36 of the lock pin 35 is returned to the first inclined groove 44*b* (see FIG. 8D). When the plunger 40 is automatically returned to the original position, the end portion 51 of the coil spring 50 biases the movable contact piece 30 so as to raise the movable contact piece 30 from a predetermined position, and the movable contact piece 30 is instantaneously turned about the turning support portion 24, thereby separating the movable contact 31 from the fixed contact 26 (see FIG. 8B). The movable contact piece 30 is turned, and one end portion of the movable contact piece 30 abuts on the pressing projection 45 of the plunger 40. Then, one end portion of the movable contact piece 30 abuts on the position regulating projected strip 64 provided in the inside surface of the housing 60, thereby regulating the position of the movable contact piece 30. Then, the upper end portion 36 of the lock pin 35 is returned to the initial region 44*a* (see FIG. 8E).

Figure 9:
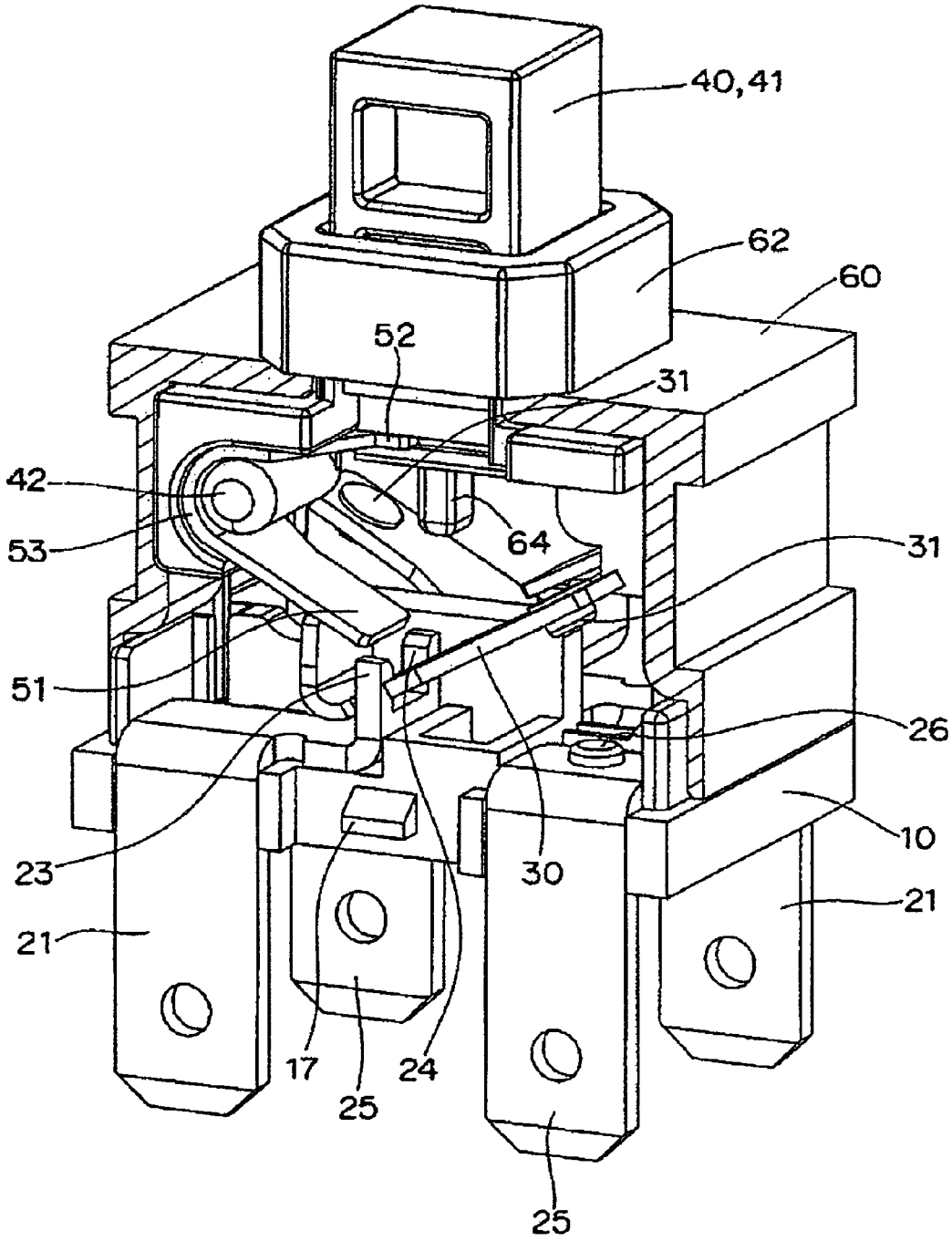
FIG. 9 shows a partially sectional perspective view of a switch according to a second embodiment of the invention.

Referring to FIG. 9, a configuration of a switch according to a second embodiment of the invention is substantially similar to that of first embodiment except that a leaf spring 53 which is made of a belt-like elastic material bent into a substantially V-shape in section is used instead of the coil spring 50. In the second embodiment, the end portions 51 and 52 of the leaf spring 53 are flexed and assembled in the plunger 40. The end portion 51 of the leaf spring 53 can slidably be moved while biasing the other end edge portion of the movable contact piece 30. Therefore, the movable contact piece 30 is instantaneously turned by the spring force of the leaf spring 53, and the movable contact 31 is come into contact with the fixed contact 26 or the movable contact 31 is separated from the fixed contact 26. Because other configurations of the second embodiment are similar to those of the first embodiment, the same component is denoted by the same reference numeral, and the description is neglected.

Figure 10:
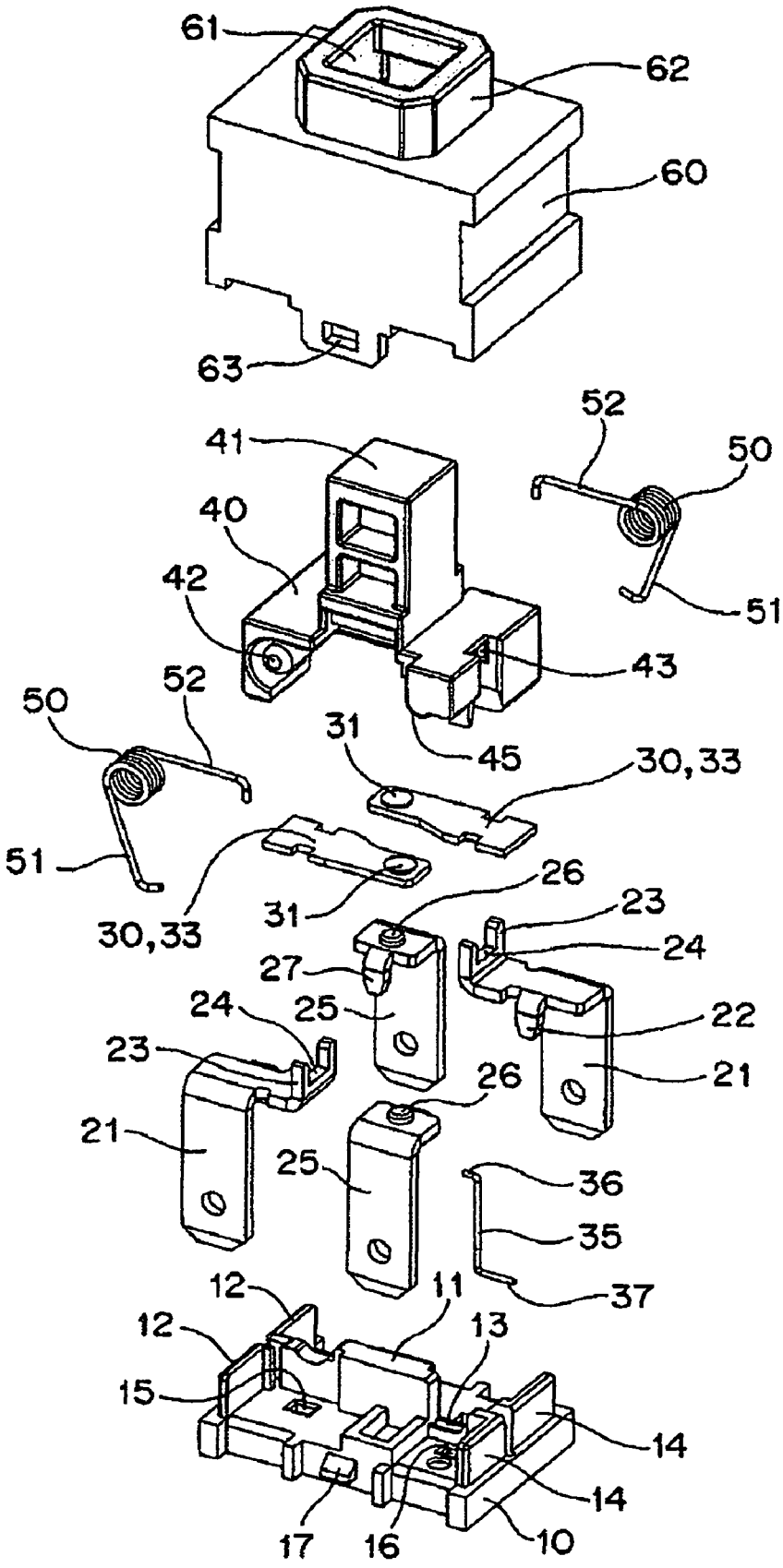
FIG. 10 shows an exploded perspective view of a switch according to a third embodiment of the invention.
Figure 11B:
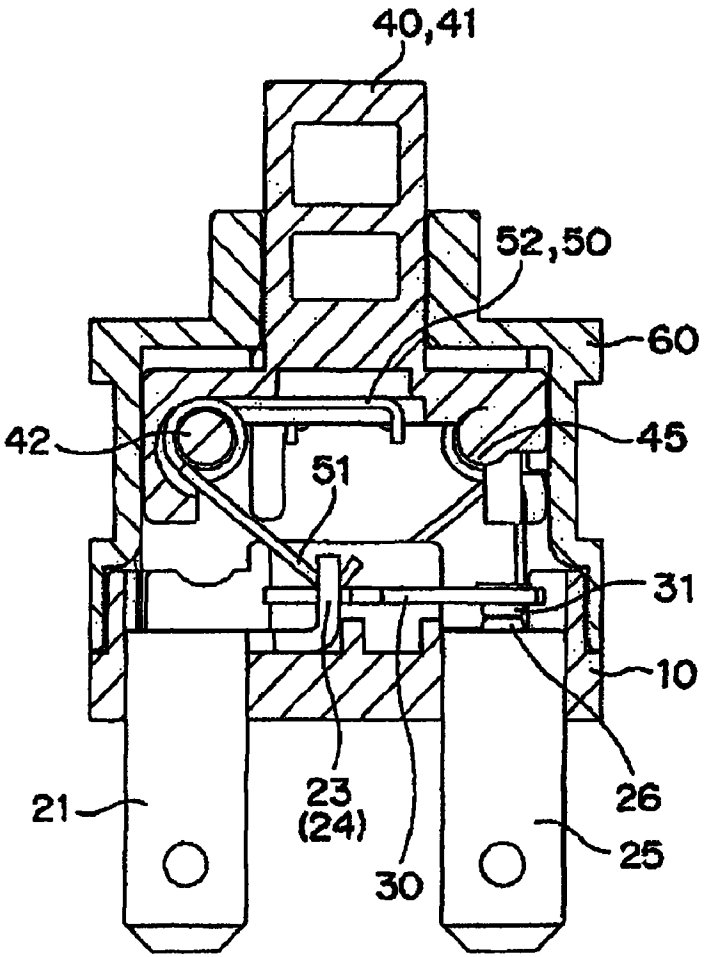
FIGS. 11A and 11B show sectional views of a working procedure of the third embodiment.

Referring to FIGS. 10 to 12, a basic structure of a switch according to a third embodiment of the invention is substantially similar to that of first embodiment except that the straight movable contact piece 30 is turned to open and close the contact. That is, as shown in FIG. 10, the movable contact 31 is provided in one end portion of the movable contact piece 30 made of a straight belt-like electroconductive material, and the narrow portion 33 provided in an intermediate portion of the movable contact piece 30 is turnably assembled in the turning support portion 24 of the support terminal 21. Additionally, front-end portions of the end portions 51 and 52 of the coil spring 50 are bent inward so as to be smoothly slid. Here, the same component is denoted by the same reference numeral, and the description is neglected.

Figure 11A:
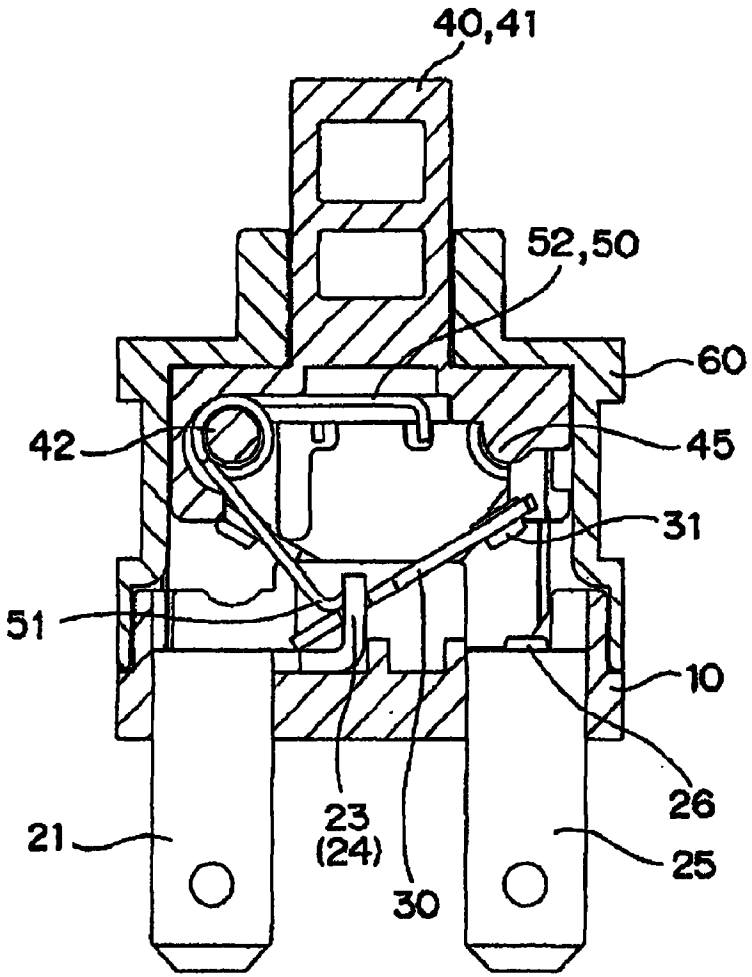
Figure 12B:
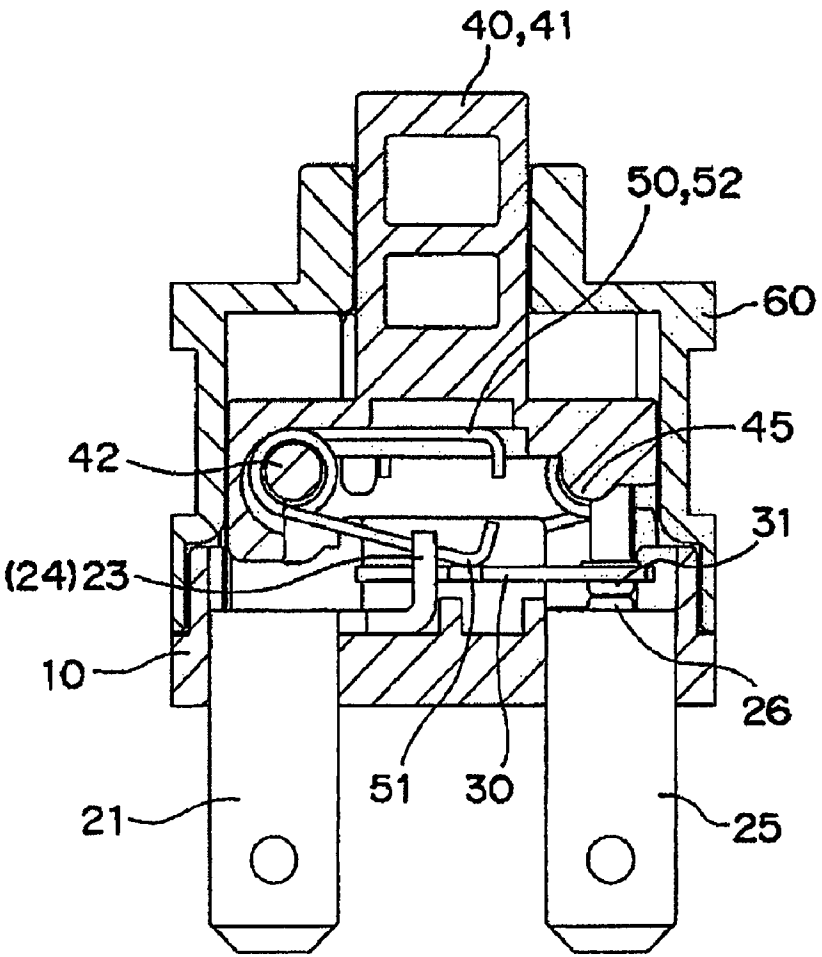
FIGS. 12A and 12B show sectional views of the working procedure subsequent to FIG. 11.
Figure 12A:
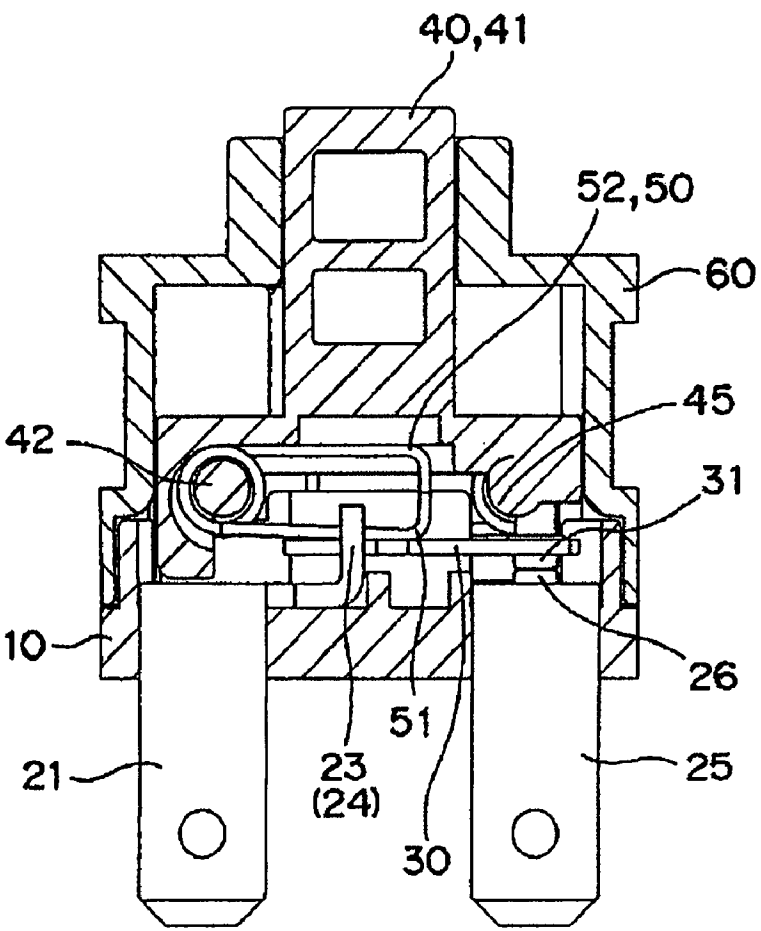

A method for working the switch of the third embodiment will briefly be described below. As shown in FIG. 11A, before working the switch, while the plunger 40 is biased upward by the spring force of the coil spring 50, the end portion 51 of the coil spring 50 pushes down the other end portion of the movable contact piece 30. Therefore, an upper surface edge portion on one end portion side of the movable contact piece 30 abuts on the lower end portion of the position regulating projected strip (not shown) projected from the inside surface of the housing 60, thereby regulating the position of the movable contact piece 30 to prevent the dropout. At this point, similarly to first embodiment, the upper end portion of the lock pin is located in the initial region 44*a* of the cam groove of the plunger 40.

When the working portion 41 of the plunger 40 is pushed down, the coil spring 50 is flexed, and the end portion 51 of the coil spring 50 biases the movable contact piece 30 so as to raise the movable contact piece 30 while being slid on the upper surface of the movable contact piece 30 (see FIG. 11A). The pressing projection 45 pushes down one end portion of the movable contact piece 30. At this point, the upper end portion of the lock pin is moved from the initial region of the cam groove through the first and second inclined grooves. When the end portion 51 of the coil spring 50 is slid to exceed a predetermined position by pushing into the working portion 41 of the plunger 40, the end portion 51 of the coil spring 50 biases the movable contact piece 30 so as to push down the movable contact piece 30. Therefore, the movable contact piece 30 is instantaneously turned about the turning support portion 24, and the movable contact 31 contacts the fixed contact 26 (see FIG. 11B).

Then, the working portion 41 of the plunger 40 is pushed into the lowest position of the working portion 41 (see FIG. 12A) and the pressing of the working portion 41 is released, whereby the plunger 40 is pushed up by the spring force of the coil spring 50. At this point, the upper end portion of the lock pin (not shown) latches the plunger at the lock position of the cam groove to regulate the upward return of the plunger, and the plunger becomes the locked state. Therefore, the end portion 51 of the coil spring 50 continuously biases the movable contact piece 30 so as to push down the movable contact piece 30, and the movable contact 31 continuously contacts the fixed contact 26 (see FIG. 12B).

In the case where the locked state (see FIG. 12B) is released, similarly to the first embodiment, the working portion 41 of the plunger 40 is further pushed down, whereby the upper end portion of the lock pin is moved from the lock position to the fourth inclined groove to release the locked state. When the pressing against the working portion 41 is released, the end portion 51 of the coil spring 50 is slid to push up the plunger 40 while biasing the movable contact piece 30, and the upper end portion of the lock pin is returned to the first inclined groove. When the plunger 40 is returned to the original position, the end portion 51 of the coil spring 50 is slid to reach a predetermined position, the spring force of the coil spring 50 biases the movable contact piece 30 so as to raise the movable contact piece 30, and the movable contact piece 30 is instantaneously turned about the turning support portion 24, thereby separating the movable contact 31 from the fixed contact 26. The movable contact piece 30 is turned, and one end portion of the movable contact piece 30 abuts on the pressing projection 45 of the plunger 40. Then, one end portion of the movable contact piece 30 abuts on the position regulating projected strip provided in the inside surface of the housing 60, and the lock pin 35 is returned to the initial region while the position of the movable contact piece 30 is regulated.

Referring to FIGS. 13 to 26, a basic structure of a switch according to a fourth embodiment of the invention is substantially similar to that of first embodiment except for the following points. A first different point is that a forced disjunction pawl portion 54 and an assembling bent portion 55 are provided in the end portion 51 of the coil spring 50 while bent. A second different point is that the lock pin 35 can be retrofitted from a bottom surface of the base 10. A third different point is that a positioning projected strip 65 is provided in the inside surface of the housing 60, and the coil spring 50 is laterally pressed to perform the positioning, thereby eliminating looseness.

That is, as shown in FIGS. 13 to 16, the switch of the fourth embodiment includes the base 10, the two sets of contact mechanisms 20 and 20, the plunger 40, and the housing 60. The two sets of contact mechanisms 20 and 20 are assembled into the base 10. The plunger 40 includes the pair of coil springs 50 and 50 and the lock pin 35, and the plunger 40 works the contact mechanism 20. The housing 60 is fitted in the base 10 to cover the contact mechanism 20 therewith, and the housing 60 supports the plunger 40 while the plunger 40 can vertically be moved.

Figure 14:
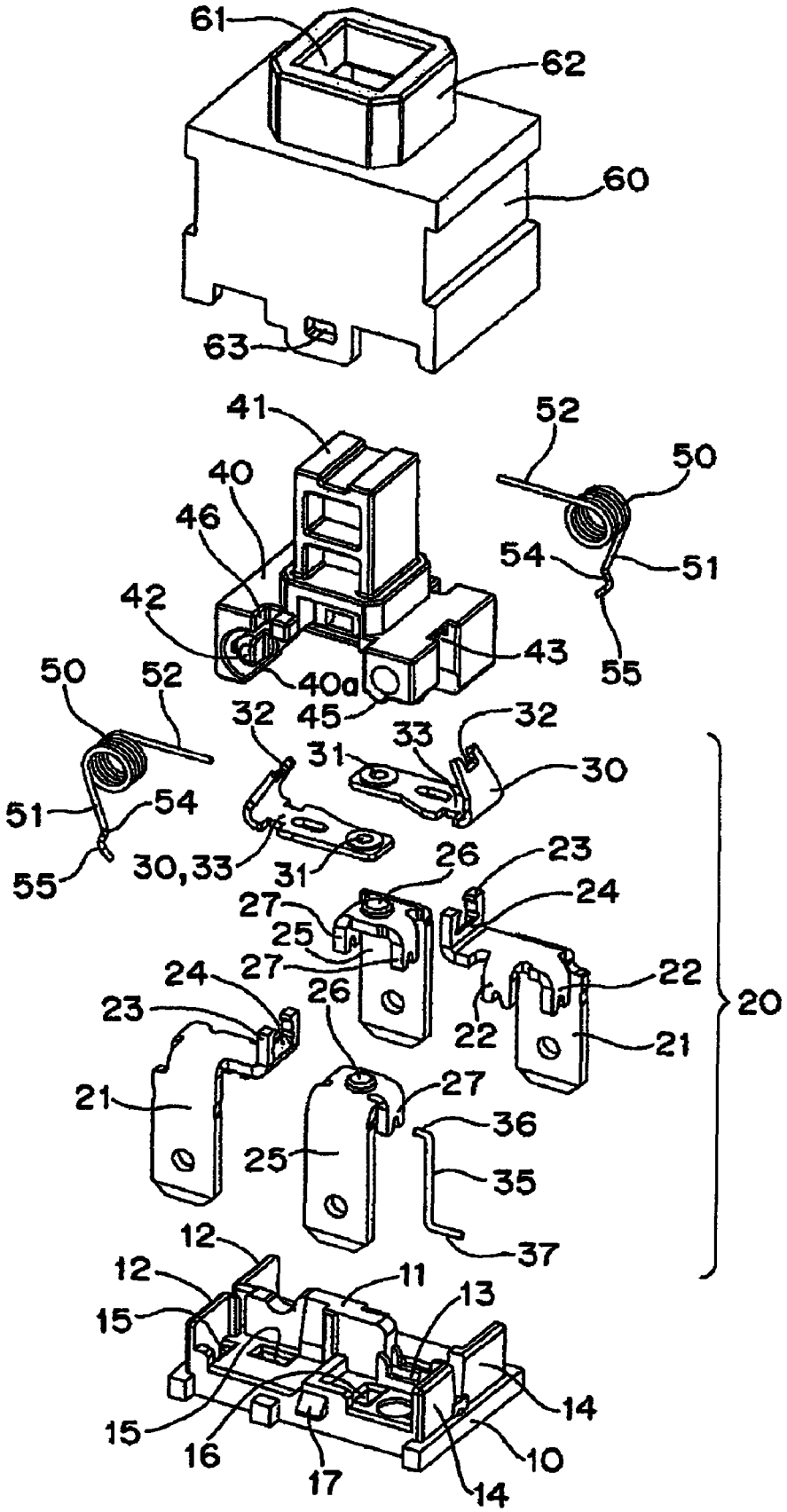
FIG. 14 shows an exploded perspective view of the switch of FIG. 13.

Referring to FIG. 14, in the base 10, the pair of insulating walls 12 and 12 is projected on the same straight line from one end portion side of the partition 11 projected in the center of the upper surface of the base 10, the engagement groove 13 is provided on the extended line on the other end portion side, and the pair of insulating walls 14 and 14 is projected on the same straight line from the other end portion side of the engagement groove 13. The press-fitting rectangular holes 15 and 15 are made near the insulating wall 12, and the press-fitting rectangular holes 16 and 16 are made near the insulating wall 14. The engaging projections 17 and 17 are provided in the parallel outside surfaces of the base 10 respectively. Further, an insertion hole 18 is made in the bottom surface of the base 10 in order to retrofit the lock pin 35, and the insertion hole 18 is communicated with the engagement groove 13. An engagement projection 18*a* and an elastic pawl portion 18*b* are project from an inside surface of the insertion hole 18. The engagement projection 18*a* engages the lock pin 35, and the elastic pawl portion 18*b* prevents the dropout of the lock pin 35.

As shown in FIG. 14, the contact mechanism 20 includes the support terminal 21, the fixed contact terminal 25, and the movable contact piece 30. The support terminal 21 is made of the electroconductive material bent into the L-shape in section. The press-fitting tongue pieces 22 and 22 are extended from the adjacent edge portions of one end portion of the support terminal 21, and the rising piece 23 is extended from the remaining edge portion of one end portion of the support terminal 21. The front-end edge portion of the rising piece 23 is notched to form the turning support portion 24. The support terminal 21 is assembled by press-fitting the press-fitting tongue pieces 22 and 22 in the press-fitting rectangular holes 15 and 15 of the base 10.

The fixed contact terminal 25 is bent into the L-shape in section. In the fixed contact terminal 25, the fixed contact 26 is provided in one end portion, and the press-fitting tongue pieces 27 and 27 are extended from an edge portion of edge portions on both sides of one end portion. The fixed contact terminal 25 is assembled by press-fitting the press-fitting tongue pieces 27 and 27 in the press-fitting rectangular holes 16 and 16 of the base 10.

The movable contact piece 30 is made of the belt-like electroconductive material bent into the J-shape in section. In the movable contact piece 30, the movable contact 31 is provided in one end portion, and the sliding notch groove 32 is formed in the front-end surface of the other end portion. The movable contact piece 30 is turnably supported by engaging the narrow portion 33 with the turning support portion 24 of the support terminal 21 (see FIG. 16). The narrow portion 33 is formed by notching the edge portions on both sides of the movable contact piece 30.

In the lock pin 35, the end portions of the metal rod are bent toward the opposite directions to form the upper and lower end portions 36 and 37. An assembling method in which the retrofit of the lock pin 35 is utilized is described later.

Figure 15A:
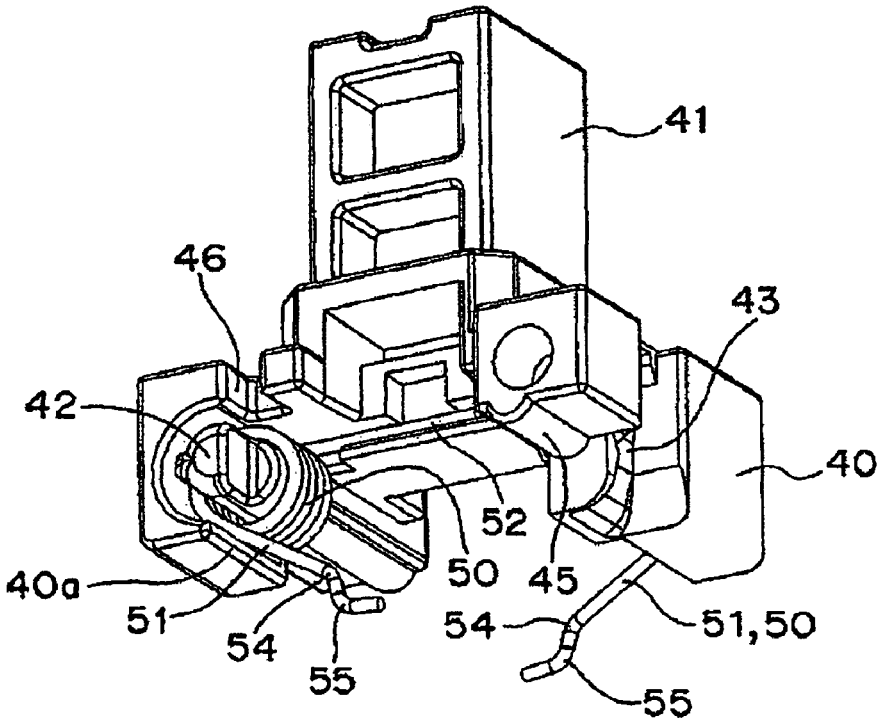
FIGS. 15A and 15B show perspective views of a plunger and a base of FIG. 14.
Figure 15B:
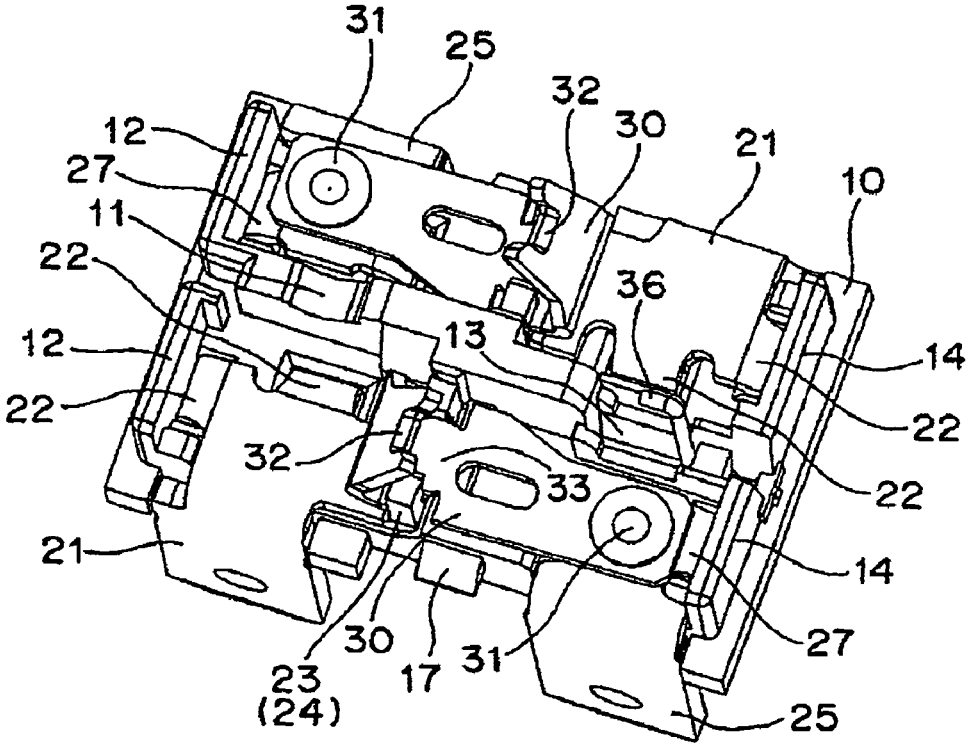
Figure 16:
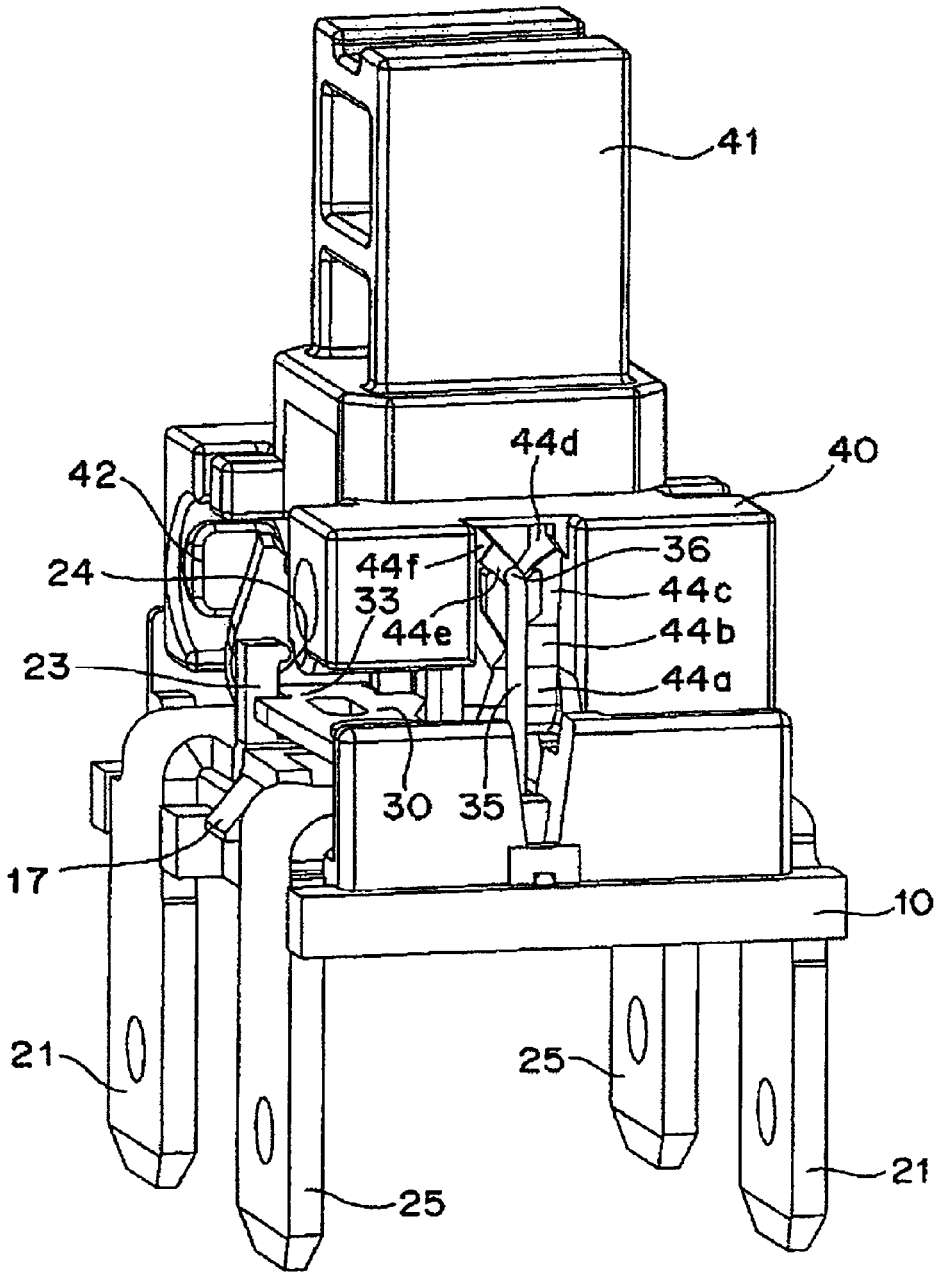
FIG. 16 shows a perspective view of a state in which a housing is detached from the switch of FIG. 13.

As shown in FIG. 14, the plunger 40 has the flat surface shape which can be accommodated between the facing insulating walls 12 and 14 of the base 10, and the working portion 41 is projected from the center of the upper surface of the plunger 40. In the plunger 40, the shaft portions 42 are point-symmetrically formed in the front surface and rear surface, and the shaft portions 42 are laterally inserted into the coil springs 50 and 50 to support the coil springs 50 and 50. The cam groove 43 is formed in the outside surface of the plunger 40. The cam groove 43 locks the plunger 40 at a position while the lock pin 35 is interposed therebetween. As shown in FIG. 15A, the pressing projection 45 is provided in parallel with the shaft portion 42 in the lower surface of the plunger 40, and a fitting groove 46 is provided in a side surface of the plunger 40.

As shown in FIG. 14, in the coil spring 50, the forced disjunction pawl portion 54 and the assembling bent portion 55 are formed by bending the front end portion of the extended end portion 51. The end portions 51 and 52 of the coil spring 50 are flexed inside, and the shaft portions 42 of the plunger 40 are inserted into the end portions 51 and 52, whereby the end portion 52 press-contacts the ceiling surface of the plunger 40 while the end portion 51 press-contacts the edge portion 40*a* of the plunger 40. Therefore, the dropout of the coil spring 50 can be prevented to facilitate the assembling work.

Figure 13B:
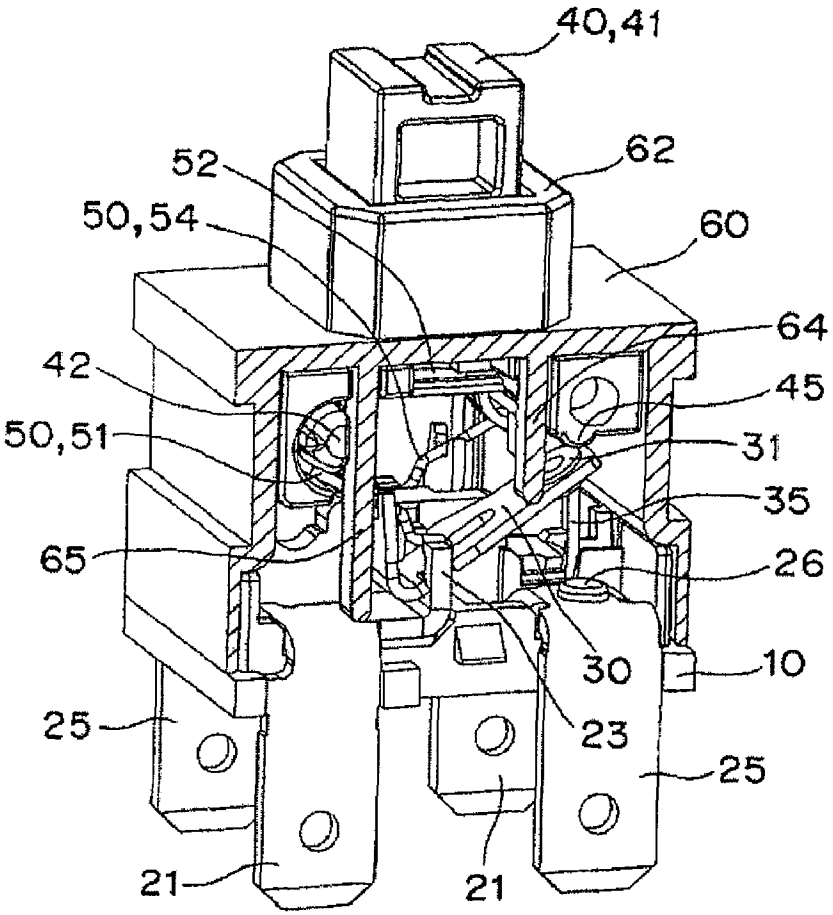
FIGS. 13A and 13B show a perspective view and a partially sectional perspective view of a switch according to a fourth embodiment of the invention.
Figure 13A:
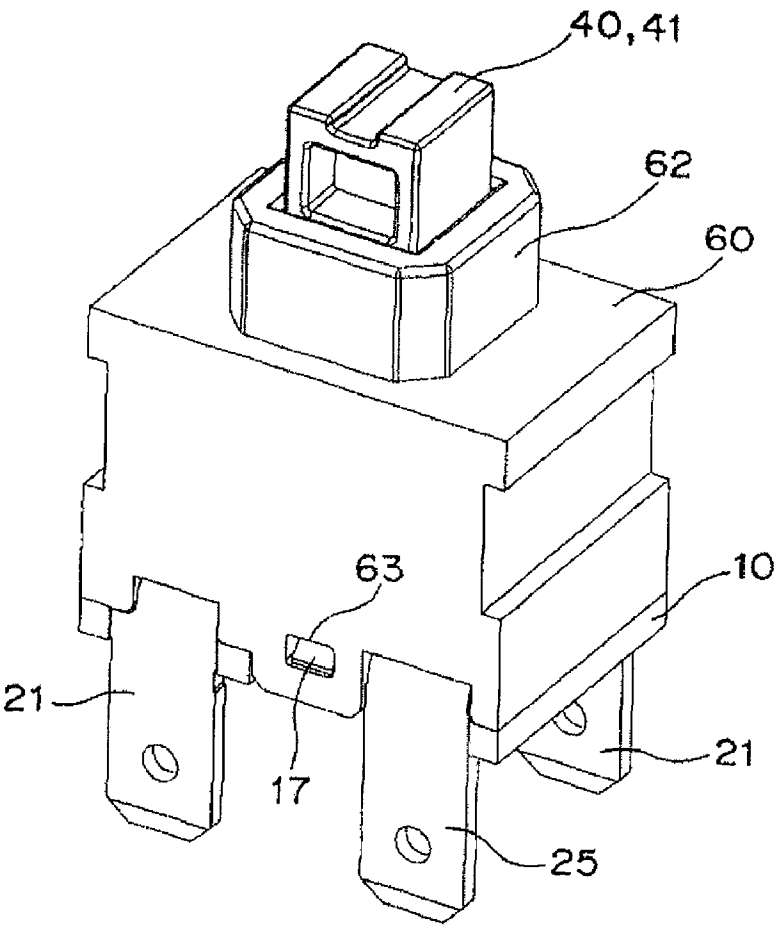

As shown in FIG. 14, the housing 60 has a box shape so as to be able to be fitted in the outer peripheral portion of the base 10 in which the contact mechanism 20 and the plunger 40 are assembled, and the circular rib 62 is provided in the opening edge portion of the working hole 61 made in the center of the upper surface of the housing 60. The pair of engagement hole 63 is made in the lower opening edge portion of the housing 60 so as to face each other. As shown in FIG. 13B, the position regulating projected strip 64 and the positioning projected strip 65 are provided in the inside surface of the housing 60. The lower end portion of the position regulating projected strip 64 abuts on the movable contact piece 30 to regulate the position of the movable contact piece 30. The positioning projected strip 65 abuts laterally on the coil spring 50 fitted in the shaft portion 42 of the plunger 40, thereby positioning the coil spring 50.

Figures 17A, 17B, 17C:
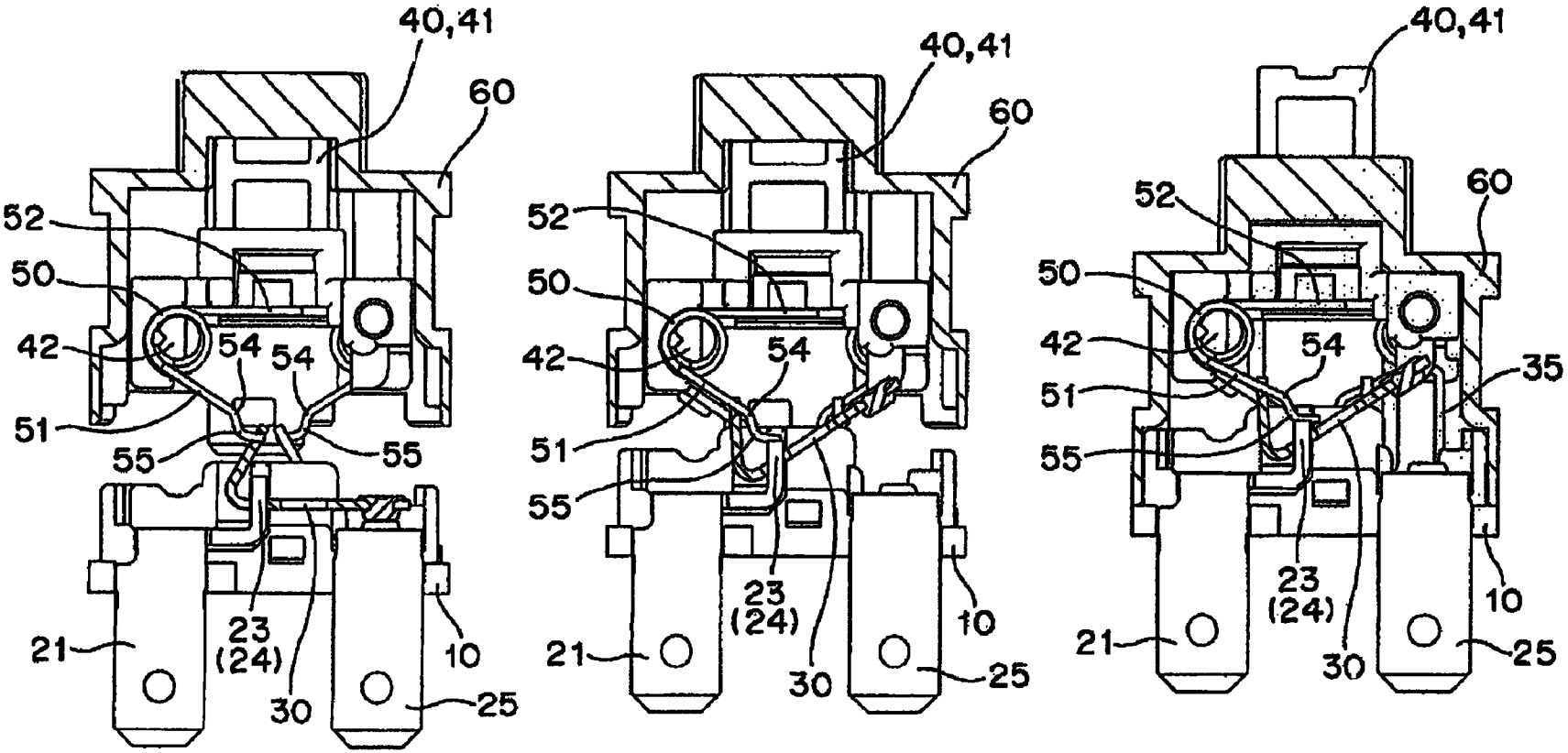
FIGS. 17A, 17B, and 17C show partially sectional views of a housing assembling process.

A method for assembling the switch of the fourth embodiment will be described below. The plunger 40 in which the coil spring 50 is placed to the shaft portion 42 is assembled in the housing 60. Therefore, the positioning projected strip 65 provided in the inside surface of the housing 60 is fitted in the fitting groove 46 of the plunger 40, and the positioning projected strip 65 laterally presses the coil spring 50, thereby positioning the coil spring 50. As shown in FIG. 17, the housing 60 is assembled from above in the base 10 in which the contact mechanism 20 is assembled (see FIG. 17A). Therefore, the assembling bent portion 55 provided in the end portion 51 of the coil spring 50 is slid inside from the sliding notch groove 32 of the movable contact piece 30 (see FIG. 17B). When the plunger 40 is pushed down, the end portion 51 of the coil spring 50 is slid in the notch groove 32, and the end portion 51 of the coil spring 50 biases the movable contact piece 30 so as to raise the movable contact piece 30, thereby separating the movable contact 31 from the fixed contact 26. Then, the engaging projection 17 of the base 10 is fitted in the engagement hole 63 of the housing 60 to complete the assembly (see FIG. 17C). In the fourth embodiment, because the end portion 51 of the coil spring 50 is surely assembled in the movable contact piece 30 while the assembling bent portion 55 of the coil spring 50 is interposed therebetween, advantageously the skilled work is not required in the assembly and the high productivity is achieved.

Figures 18A, 18B, 18C:
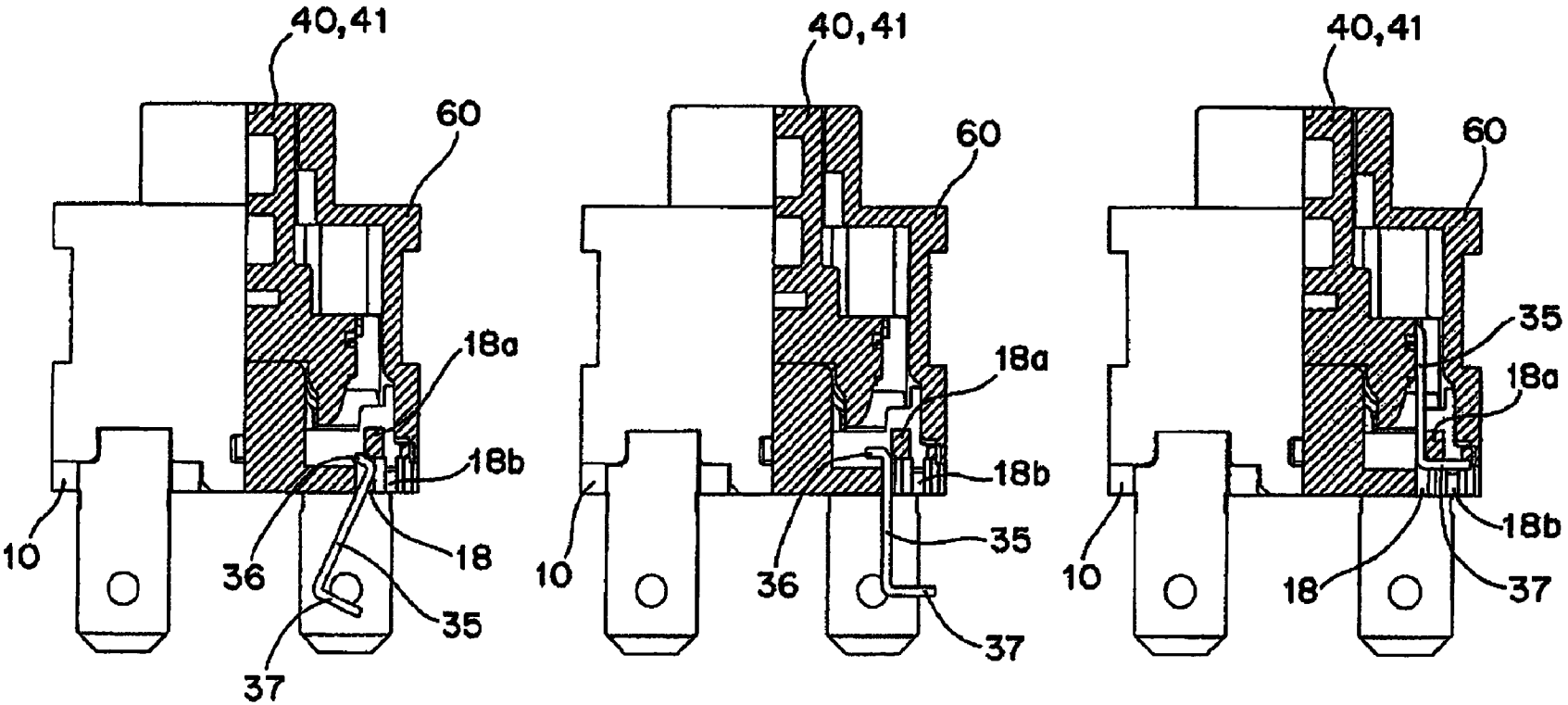
FIGS. 18A, 18B, and 18C show partially sectional views of a lock pin assembling process.
Figure 19A:
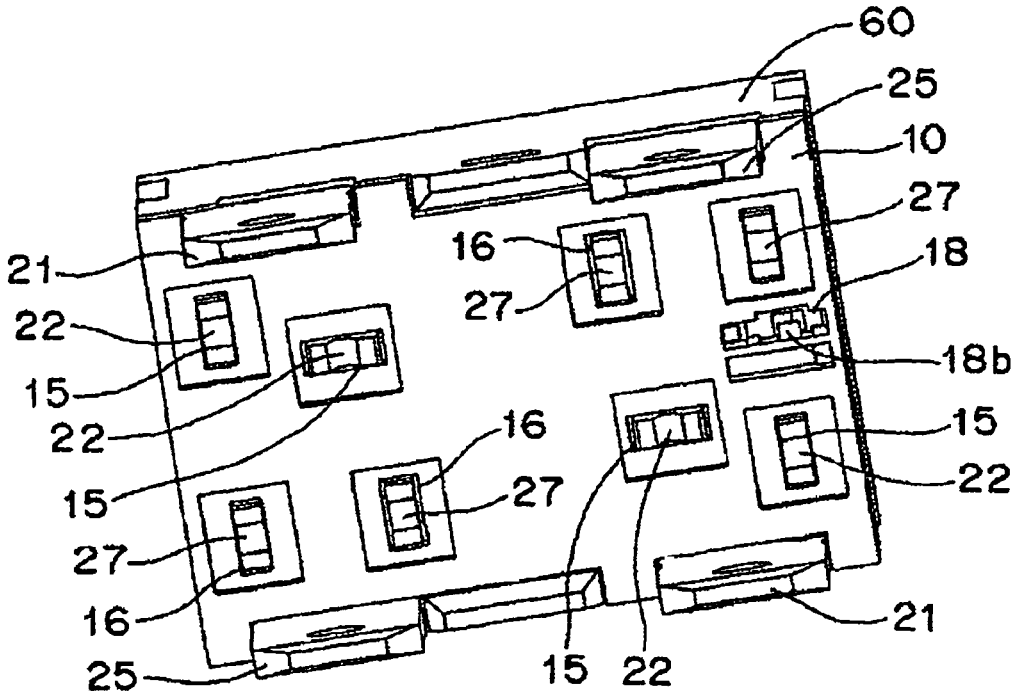
FIGS. 19A and 19B show perspective views before and after the lock pin assembly.
Figure 19B:
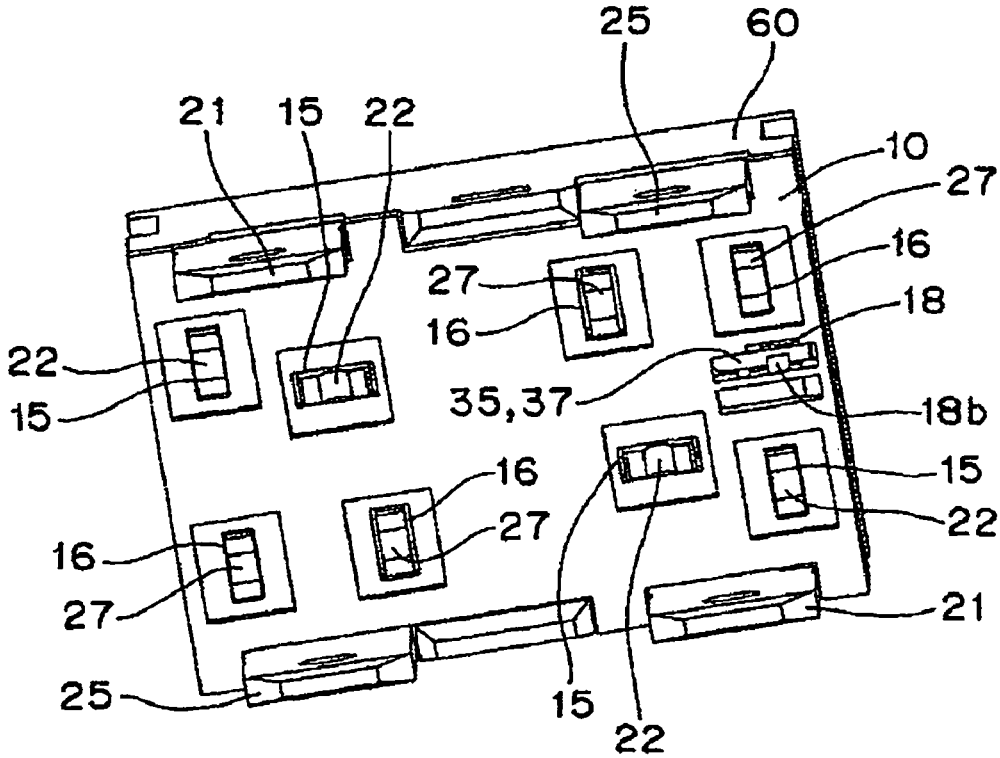
Figure 20A:
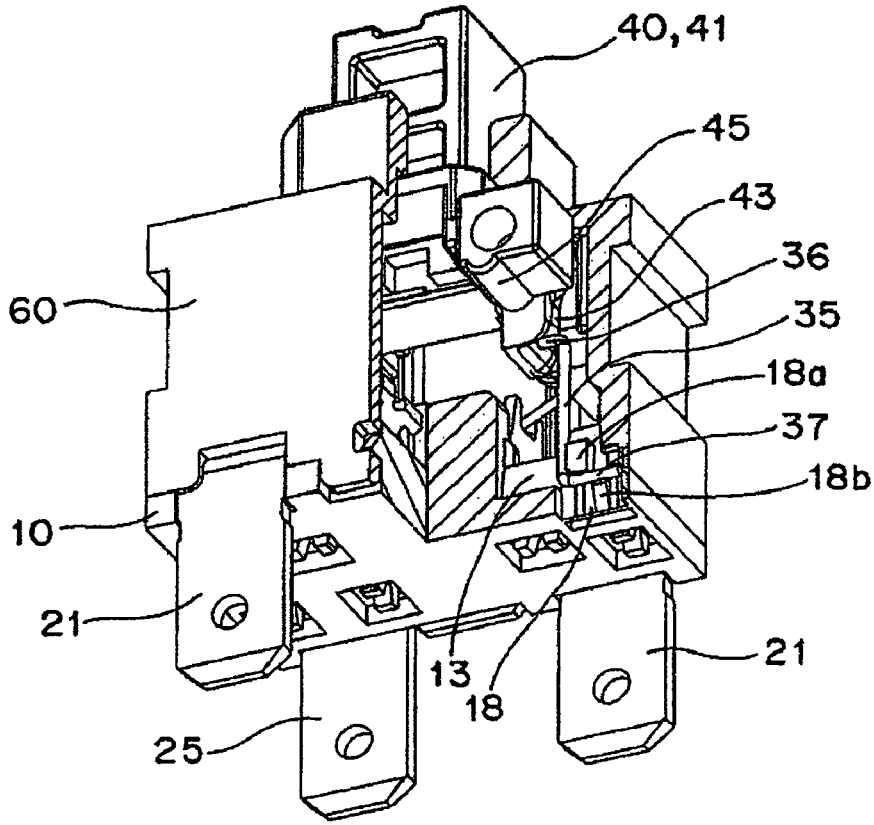
FIGS. 20A and 20B show a partially sectional perspective view and a partially sectional view after the lock pin assembly.
Figure 20B:
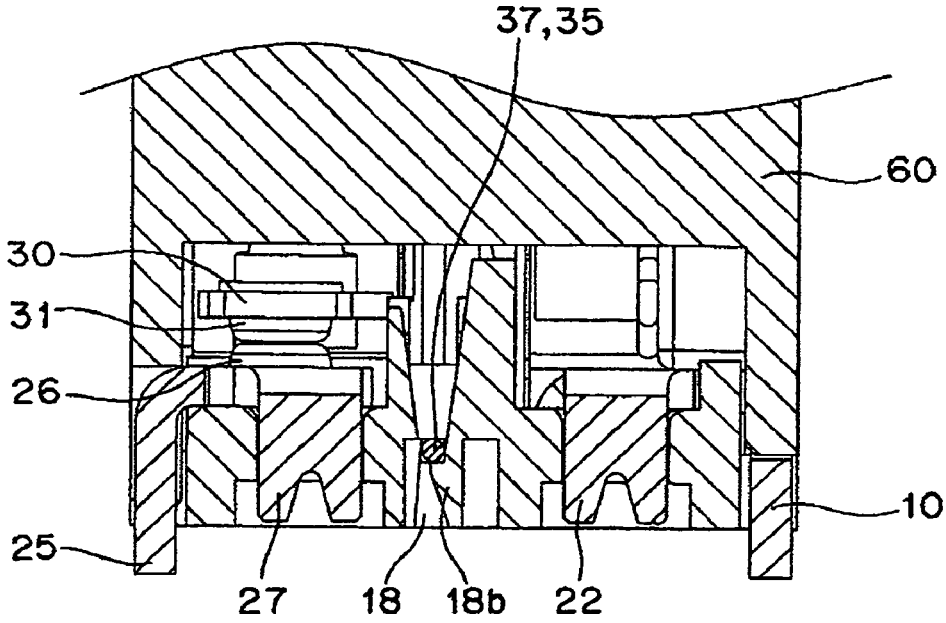

A method for assembling the lock pin 35 will be described below. As shown in FIG. 18, the lock pin 35 is obliquely inserted in the insertion hole 18 made in the bottom surface of the base 10 so as to avoid the engagement projection 18*a* (see FIG. 18A), the lock pin 35 is perpendicularly raised (see FIG. 18B) and projected from the engagement groove 13, and the lower end portion 37 is engaged with the elastic pawl portion 18*b* to prevent the dropout (see FIGS. 18C and 20). Therefore, the upper end portion 36 engages the cam groove 43 of the plunger 40 (see FIG. 20). In the fourth embodiment, because the lock pin 35 can be retrofitted, the assembly becomes simplified and the high productivity is achieved. Because the lock pin 35 is retrofitted as needed, the switch of the fourth embodiment can be used as a mere push switch unless the lock pin 35 is attached.

Figure 21C:
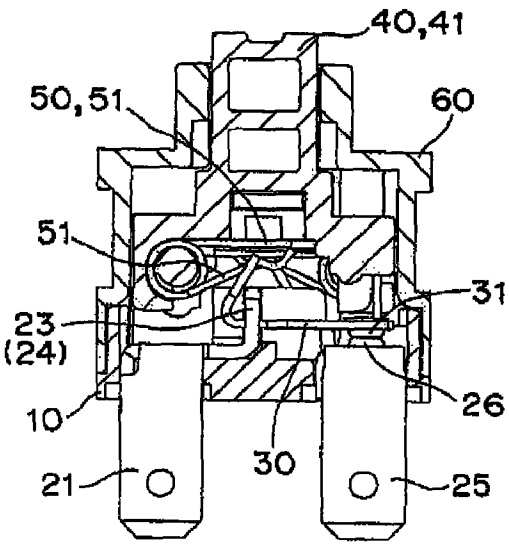
FIGS. 21A, 21B, and 21C show sectional views of a working procedure.
Figure 21B:
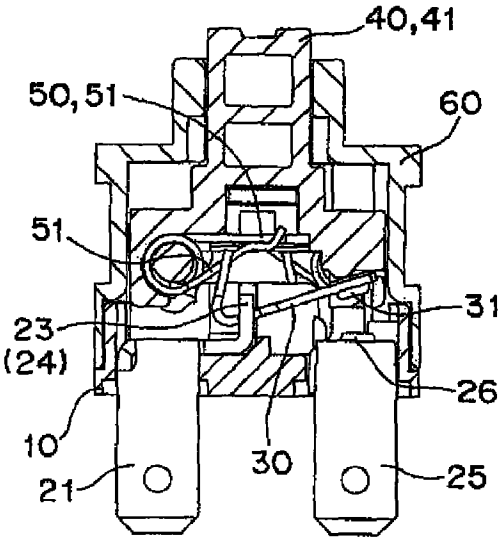
Figure 21A:
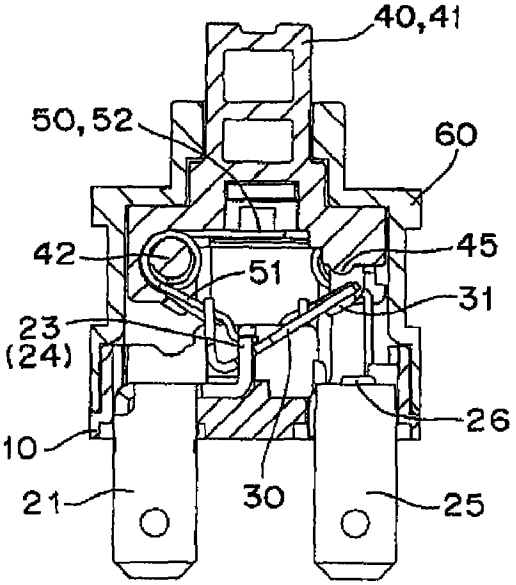
Figure 21E:
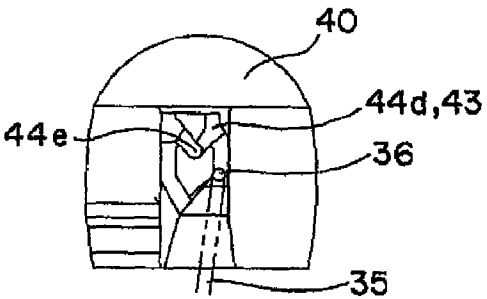
FIGS. 21D and 21E show partially enlarged views of a cam mechanism operation.
Figure 21D:
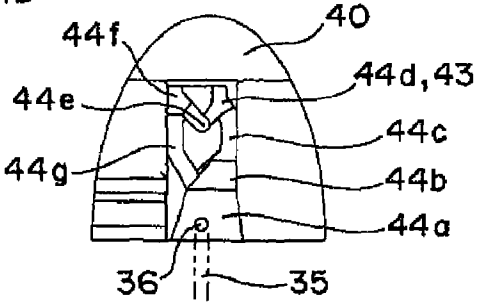

A method for working the switch of the fourth embodiment will be described below. As shown in FIG. 21A, before working the switch, the plunger 40 is biased upward by the spring force of the coil spring 50. On the other hand, the end portion 51 of the coil spring 50 pushes down the other end portion of the movable contact piece 30. Therefore, one end portion of the movable contact piece 30 abuts on the lower end portion of the position regulating projected strip 64 (see FIG. 13B) projected from the inside surface of the housing 60, thereby regulating the position of the movable contact piece 30 to prevent the dropout. At this point, as shown in FIG. 21D, the upper end portion 36 of the lock pin 35 is located in the initial region 44*a* of the cam groove 43 of the plunger 40.

When the working portion 41 of the plunger 40 is pushed down, the coil spring 50 is flexed, and the end portion 51 of the coil spring 50 biases the movable contact piece 30 so as to raise the movable contact piece 30 while being slid in the notch groove 32 of the movable contact piece 30. The pressing projection 45 pushes down one end portion of the movable contact piece 30. At this point, the upper end portion 36 of the lock pin 35 is moved from the initial region 44*a* of the cam groove 43 through the first and second inclined grooves 44*b* and 44*c*. When the end portion 51 of the coil spring 50 exceeds a predetermined position by pushing into the working portion 41 of the plunger 40, the end portion 51 of the coil spring 50 biases the movable contact piece 30 so as to push down the movable contact piece 30. Therefore, the movable contact piece 30 is instantaneously turned about the turning support portion 24, and the movable contact 31 contacts the fixed contact 26 (see FIG. 21C).

Figure 22B:
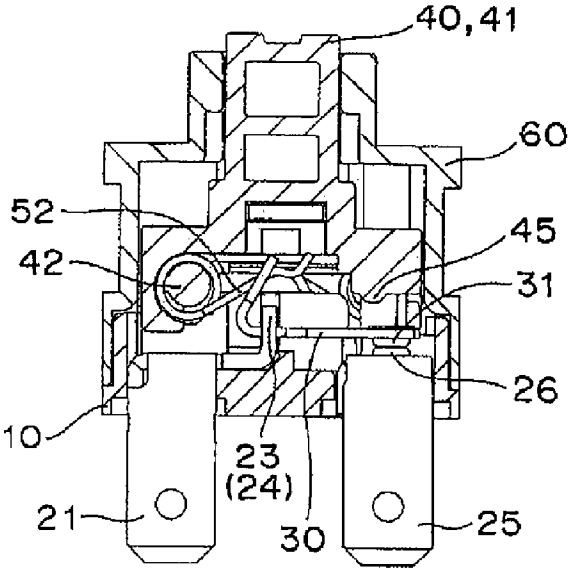
FIGS. 22A and 22B show sectional views of the working process subsequent to FIG. 21, and FIGS. 22C and 22D show partially enlarged views of the cam mechanism operation subsequent to FIG. 21.
Figure 22D:
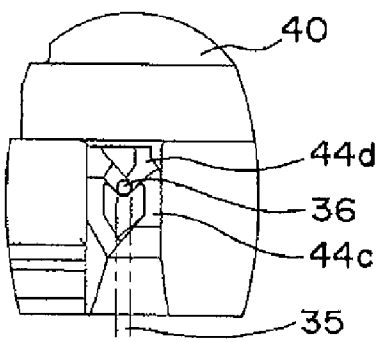
Figure 22A:
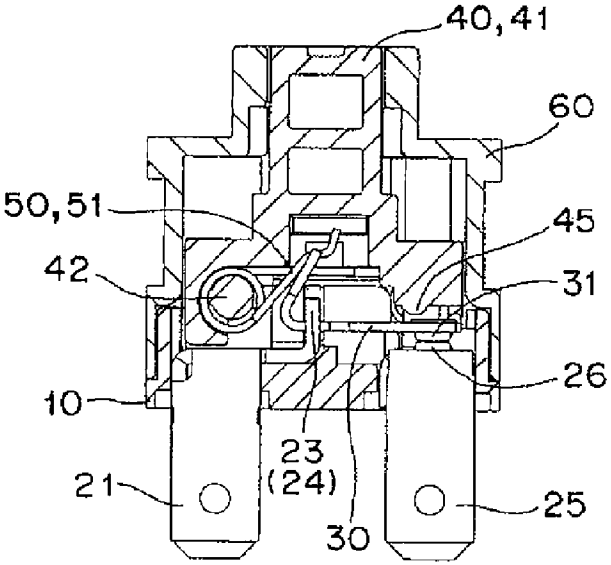
Figure 22C:
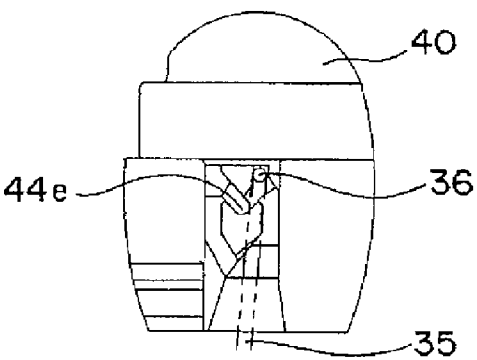

Then, the working portion 41 of the plunger 40 is pushed into the lowest position of the working portion 41 (see FIG. 22A), whereby the upper end portion 36 of the lock pin 35 reaches the third inclined groove 44*d* (see FIG. 22C). When the pressing of the plunger 40 is released, the plunger 40 is pushed up by the spring force of the coil spring 50. At this point, the upper end portion 36 of the lock pin 35 latches the plunger 40 at the lock position 44*e* (see FIG. 22D) to regulate the upward return of the plunger 40, and the plunger 40 becomes the locked state. Therefore, the end portion 51 of the coil spring 50 continuously biases the movable contact piece 30 so as to push down the movable contact piece 30, and the movable contact 31 continuously contacts the fixed contact 26 (see FIG. 22B).

Figure 23B:
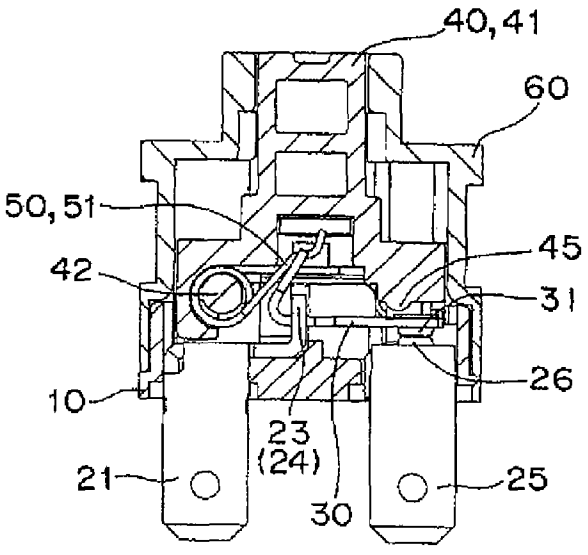
FIGS. 23A and 23B show sectional views of the working process subsequent to FIG. 22, and FIGS. 23C and 23D show partially enlarged views of the cam mechanism operation subsequent to FIG. 22.
Figure 23A:
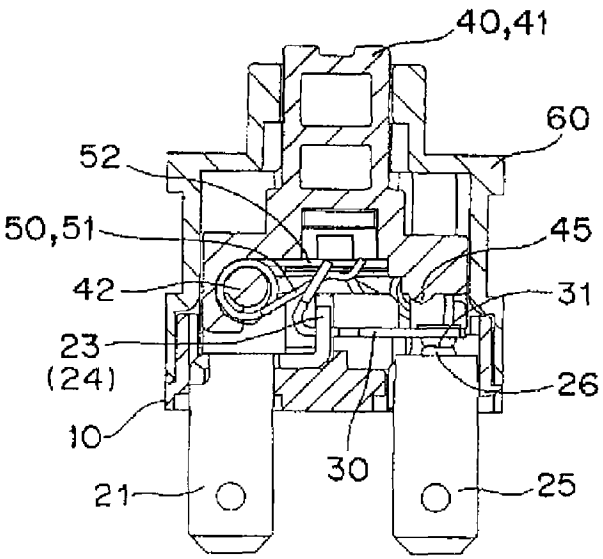
Figure 23D:
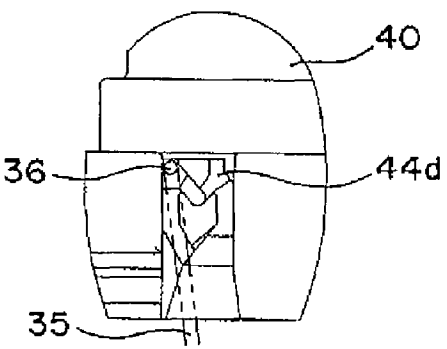
Figure 23C:
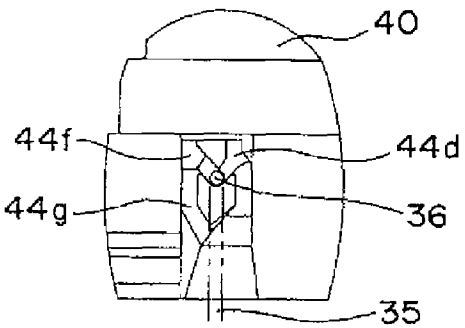
Figure 24C:
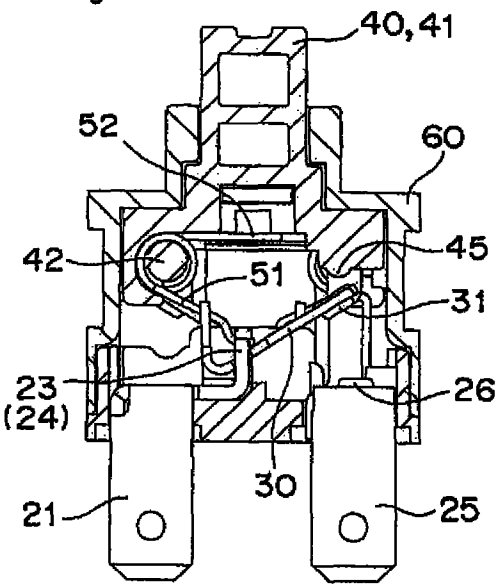
FIGS. 24A, 24B, and 24C show sectional views of a working process subsequent to FIG. 23, and FIGS. 24D and 24E show partially enlarged views of the cam mechanism operation subsequent to FIG. 23.
Figure 24B:
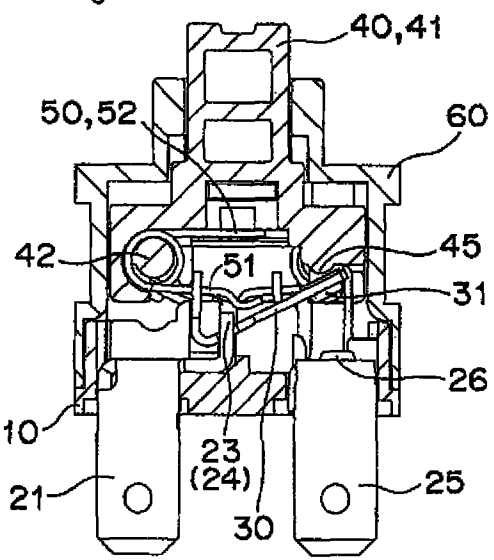
Figure 24A:
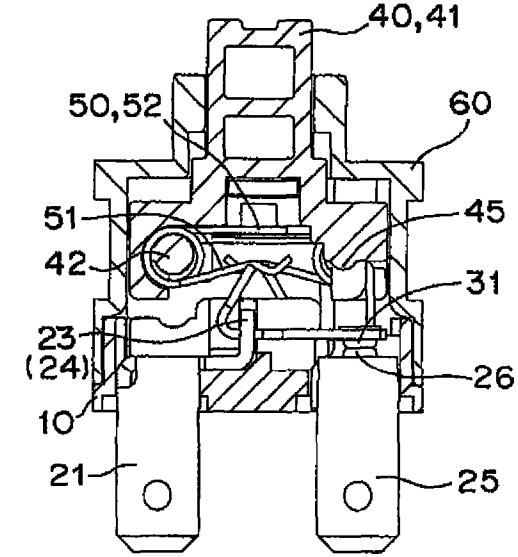
Figure 24E:
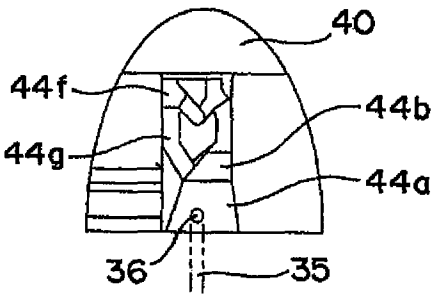
Figure 24D:
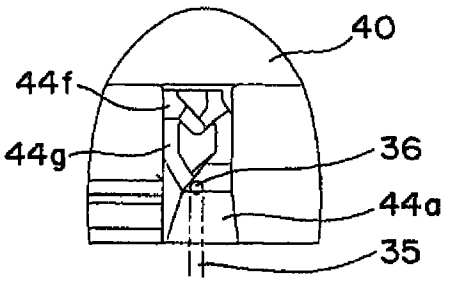

In the case where the locked state (see FIGS. 23A and 23C) is released, the working portion 41 of the plunger 40 is further pushed down (see FIG. 23B), whereby the upper end portion 36 of the lock pin 35 is moved from the lock position to the fourth inclined groove 44*f* to release the locked state (see FIG. 23D). When the pressing against the working portion 41 is released, the coil spring 50 pushes up the plunger 40 while biasing the movable contact piece 30 so as to push down the movable contact piece 30 (see FIG. 24A), and the upper end portion 36 of the lock pin 35 is returned to the first inclined groove 44*b* (see FIG. 24D). When the plunger 40 is automatically returned to the original position, the end portion 51 of the coil spring 50 biases the movable contact piece 30 so as to raise the movable contact piece 30 from a predetermined position, and the movable contact piece 30 is instantaneously turned about the turning support portion 24, thereby separating the movable contact 31 from the fixed contact 26 (see FIG. 24B). The movable contact piece 30 is turned, and one end portion of the movable contact piece 30 abuts on the pressing projection 45 of the plunger 40. Then, one end portion of the movable contact piece 30 abuts on the position regulating projected strip 64 provided in the inside surface of the housing 60, thereby regulating the position of the movable contact piece 30. Then, the upper end portion 36 of the lock pin 35 is returned to the initial region 44*a* (see FIG. 24E).

Figure 25B:
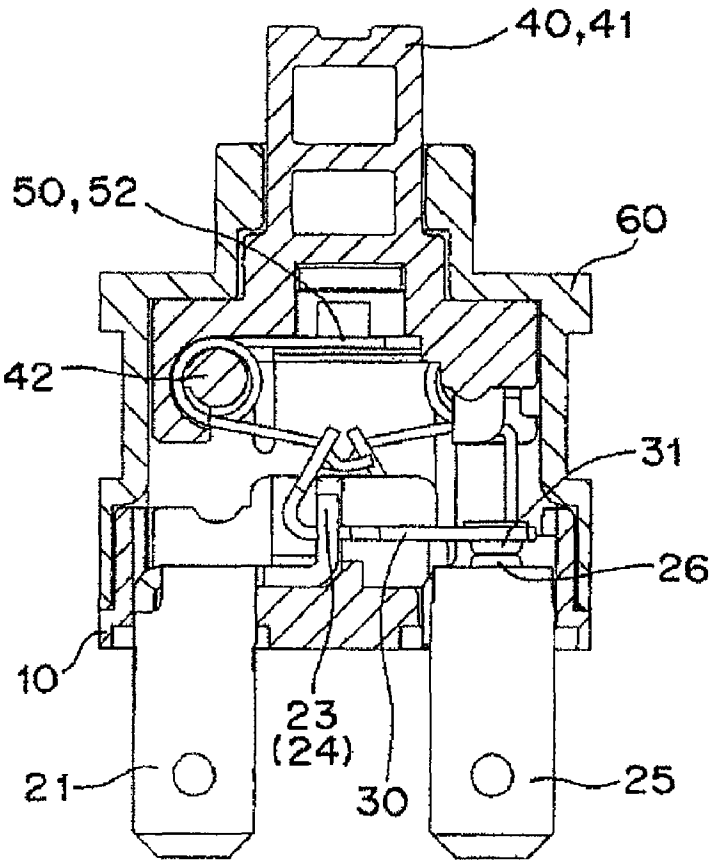
FIGS. 25A and 25B show sectional views for explaining a working procedure of forced disjunction when a contact is welded.
Figure 25A:
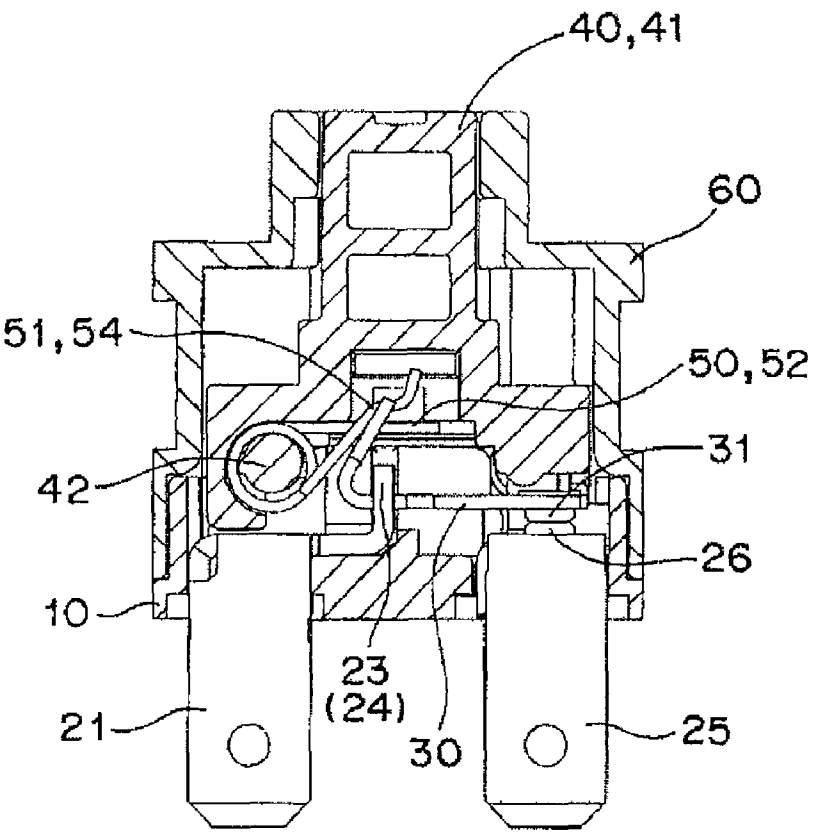
Figure 26B:
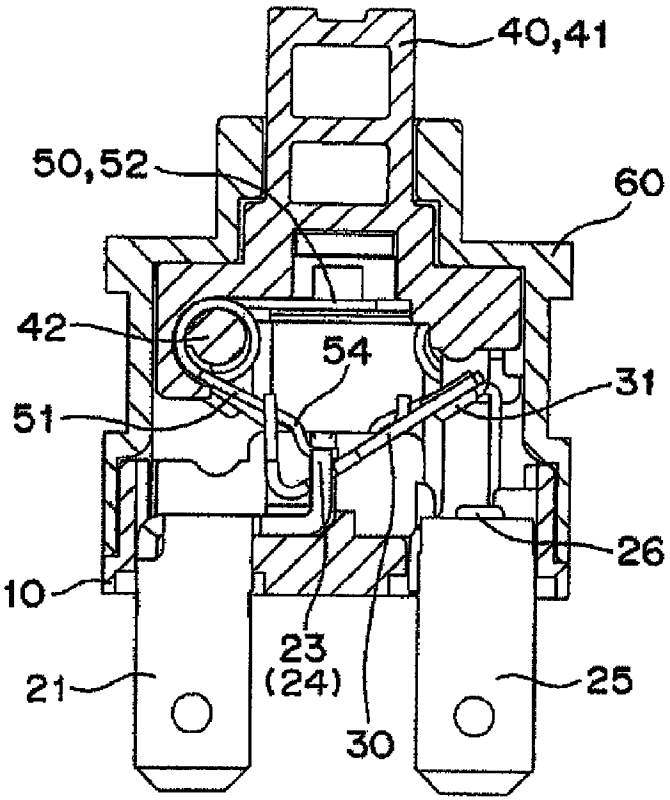
FIGS. 26A and 26B show sectional views of the working process subsequent to FIG. 25.
Figure 26A:
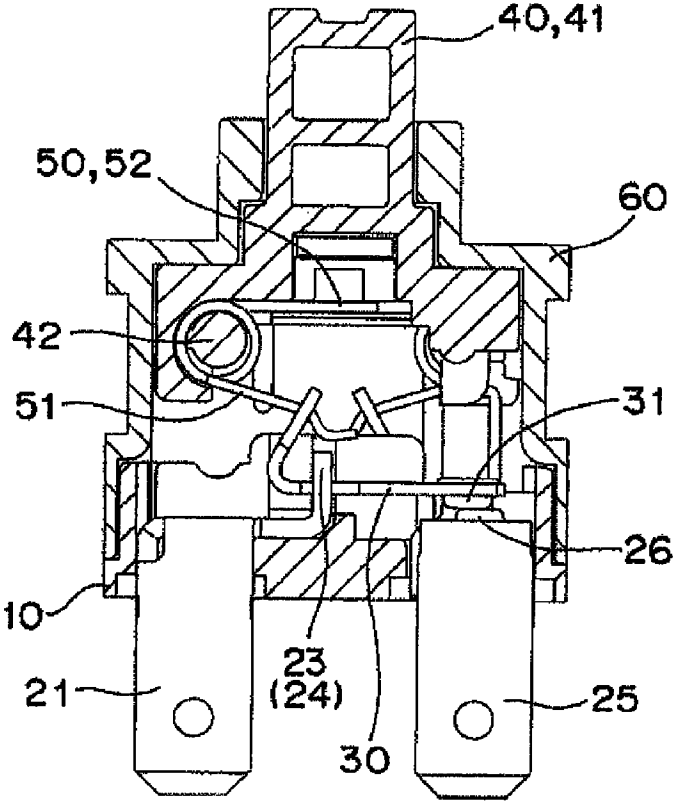

In the event that the movable contact 31 is welded to the fixed contact 26, when the pressing against the working portion 41 of the plunger 40 is released as shown in FIGS. 25 and 26, the forced disjunction pawl portion 54 provided in the end portion 51 is latched by the edge portion of the sliding notch groove 32 of the movable contact piece 30 while the end portion 52 of the coil spring 50 pushes up the working portion 41, whereby the end portion 52 of the coil spring 50 biases the movable contact piece 30 so as to raise the movable contact piece 30 (see FIG. 25B). Therefore, even if the fixed contact 26 and the movable contact 31 are welded to each other, the contact welding is broken by a horizontal component force of the coil spring 50 (see FIG. 26A). As a result, the movable contact 31 is separated from the fixed contact, the movable contact piece 30 is raised by the spring force of the end portion 51 of the coil spring 50, and the movable contact 31 is separated from the fixed contact 26 (see FIG. 26B) to prevent a malfunction.

In the fourth embodiment, obviously the lock pin 35 may be used as a mere push switch while not retrofitted. The position regulating projected strips 64 and positioning projected strip 65 provided in the inside surface of the housing 60 may be provided as needed in the first to third embodiments.

The invention is not limited to the switch in which the two sets of contact mechanisms are disposed in the base, but the invention can be applied to a switch in which one set of contact mechanisms is disposed in the base. The pressing projection 45 of the plunger 40 may be provided as needed in one of the embodiments. When the pressing projection 45 is not wanted, it is not necessary to provide the pressing projection 45.

What is claimed is:

1. A switch comprising:

a base;

a support terminal which is assembled in the base;

a movable contact piece which is made of electroconductive material bent into a substantial J-shape in section, the movable contact piece including a movable contact provided in one end portion thereof, an intermediate portion of the movable contact piece being turnably supported by a turning support portion of the support terminal;

a plunger which is accommodated in an internal space while being able to be vertically moved, the internal space being formed by fitting a housing in the base; and a coil spring which is turnably supported by the plunger, wherein the plunger is slid while vertically moved press-contact one end portion of the coil spring against the other end edge portion of the movable contact piece, whereby the movable contact piece is reversed to bring the movable contact into contact with a fixed contact or to separate the movable contact from the fixed contact.

2. The switch according to claim 1, wherein a forced disjunction pawl portion is provided in one end portion of the spring, the forced disjunction pawl portion being latched in an edge portion of the other end portion of the movable contact piece to perform forced disjunction between the fixed contact and the movable contact.

3. The switch according to claim 1, wherein an assembling bent portion is provided in one end portion of the spring, the assembling bent portion being able to be assembled by sliding the assembling bent portion on an edge portion of the other end portion of the movable contact piece.

4. The switch according to claim 1, wherein a position regulating projected strip is projected from an inside surface of the housing fitted in the base, the position regulating projected strip being latched in an upper surface edge portion of the movable contact piece to regulate a position during return.

5. The switch according to claim 1, wherein a positioning projected strip is projected from an inside surface of the housing fitted in the base, the positioning projected strip laterally press-contacting the spring to perform positioning.

6. The switch according to claim 2, wherein an assembling bent portion is provided in one end portion of the spring, the assembling bent portion being able to be assembled by sliding the assembling bent portion on an edge portion of the other end portion of the movable contact piece.

7. The switch according to claim 2, wherein a position regulating projected strip is projected from an inside surface of the housing fitted in the base, the position regulating projected strip being latched in an upper surface edge portion of the movable contact piece to regulate a position during return.

8. The switch according to claim 2, wherein a positioning projected strip is projected from an inside surface of the housing fitted in the base, the positioning projected strip laterally press-contacting the spring to perform positioning.

9. A switch comprising:

a base;

a support terminal which is assembled in the base;

a movable contact piece which is made of a straight electroconductive material, the movable contact piece including a movable contact provided in one end portion thereof, an intermediate portion of the movable contact piece being turnably supported by a turning support portion of the support terminal;

a plunger which is accommodated in an internal space while being able to be vertically moved, the internal space being formed by fitting a housing in the base; and a coil spring which is turnably supported by the plunger, wherein the plunger is slid while vertically moved press-contact one end portion of the coil spring against the other end portion on the upper surface of the movable contact piece, whereby the movable contact piece is reversed to bring the movable contact into contact with a fixed contact or to separate the movable contact from the fixed contact.

10. The switch according to claim 9, wherein a forced disjunction pawl portion is provided in one end portion of the spring, the forced disjunction pawl portion being latched in an edge portion of the other end portion of the movable contact piece to perform forced disjunction between the fixed contact and the movable contact.

11. The switch according to claim 9, wherein a position regulating projected strip is projected from an inside surface of the housing fitted in the base, the position regulating projected strip being latched in an upper surface edge portion of the movable contact piece to regulate a position during return.

12. The switch according to claim 9, wherein a positioning projected strip is projected from an inside surface of the housing fitted in the base, the positioning projected strip laterally press-contacting the spring to perform positioning.

13. A switch comprising:

a base;

a support terminal which is assembled in the base;

a movable contact piece which is made of electroconductive material bent into a substantial J-shape in section, the movable contact piece including a movable contact provided in one end portion thereof, an intermediate portion of the movable contact piece being turnably supported by a turning support portion of the support terminal;

a plunger which is accommodated in an internal space while being able to be vertically moved, the internal space being formed by fitting a housing in the base; and a leaf spring which is made of elastic material bent into a substantial V-shape in section, the leaf spring being turnably supported by the plunger, wherein the plunger is slid while vertically moved press-contact one end portion of the leaf spring against the other end edge portion of the movable contact piece, whereby the movable contact piece is reversed to bring the movable contact into contact with a fixed contact or to separate the movable contact from the fixed contact.

14. The switch according to claim 13, wherein a forced disjunction pawl portion is provided in one end portion of the spring, the forced disjunction pawl portion being latched in an edge portion of the other end portion of the movable contact piece to perform forced disjunction between the fixed contact and the movable contact.

15. The switch according to claim 13, wherein an assembling bent portion is provided in one end portion of the spring, the assembling bent portion being able to be assembled by sliding the assembling bent portion on an edge portion of the other end portion of the movable contact piece.

16. The switch according to claim 13, wherein a position regulating projected strip is projected from an inside surface of the housing fitted in the base, the position regulating projected strip being latched in an upper surface edge portion of the movable contact piece to regulate a position during return.

17. The switch according to claim 13, wherein a positioning projected strip is projected from an inside surface of the housing fitted in the base, the positioning projected strip laterally press-contacting the spring to perform positioning.

18. A switch comprising:

a base;

a support terminal which is assembled in the base;

a movable contact piece which is made of a straight electroconductive material, the movable contact piece including a movable contact provided in one end portion thereof, an intermediate portion of the movable contact piece being turnably supported by a turning support portion of the support terminal;

a plunger which is accommodated in an internal space while being able to be vertically moved, the internal space being formed by fitting a housing in the base; and a leaf spring which is made of elastic material bent into a substantial V-shape in section, the leaf spring being turnably supported by the plunger, wherein the plunger is slid while vertically moved press-contact one end portion of the leaf spring against the other end portion on the upper surface of the movable contact piece, whereby the movable contact piece is reversed to bring the movable contact into contact with a fixed contact or to separate the movable contact from the fixed contact.

19. The switch according to claim 18, wherein a position regulating projected strip is projected from an inside surface of the housing fitted in the base, the position regulating projected strip being latched in an upper surface edge portion of the movable contact piece to regulate a position during return.

20. The switch according to claim 18, wherein a positioning projected strip is projected from an inside surface of the housing fitted in the base, the positioning projected strip laterally press-contacting the spring to perform positioning.

* * * * *